US007243453B2

(12) United States Patent
McGarry

(10) Patent No.: US 7,243,453 B2
(45) Date of Patent: Jul. 17, 2007

(54) PISTOL WITH FIRING PIN LOCKING MECHANISM

(75) Inventor: James McGarry, Prescott Valley, AZ (US)

(73) Assignee: Sturm, Ruger & Company, Inc., Southport, CT (US)

( * ) Notice: Subject to any disclaimer, the term of this patent is extended or adjusted under 35 U.S.C. 154(b) by 312 days.

(21) Appl. No.: 10/825,518

(22) Filed: Apr. 15, 2004

(65) Prior Publication Data

US 2005/0229462 A1 Oct. 20, 2005

(51) Int. Cl.
*F41A 17/00* (2006.01)

(52) U.S. Cl. ..... 42/70.08; 42/70.01; 42/70.11; 89/27.12

(58) Field of Classification Search ..... 42/70.08, 42/70.01, 70.11; 89/27.12
See application file for complete search history.

(56) References Cited

U.S. PATENT DOCUMENTS

| | | | | | |
|---|---|---|---|---|---|
| 3,882,622 | A | * | 5/1975 | Perlotto | 42/70.11 |
| 4,090,316 | A | * | 5/1978 | Volkmar | 42/70.08 |
| 4,270,295 | A | | 6/1981 | Grehl | 42/70 |
| 4,768,302 | A | * | 9/1988 | Beretta | 42/70.08 |
| 4,987,693 | A | | 1/1991 | Brooks | 42/70.11 |
| 5,042,185 | A | | 8/1991 | Justice, Sr. | 42/70.11 |
| 5,081,779 | A | | 1/1992 | Pack | 42/70.11 |
| 5,088,222 | A | | 2/1992 | Larson | 42/70.04 |
| 5,157,209 | A | | 10/1992 | Dunn | 42/70.08 |
| 5,235,763 | A | | 8/1993 | Nosler et al. | 42/70.11 |
| 5,245,776 | A | * | 9/1993 | Dornaus | 42/70.08 |
| 5,251,394 | A | * | 10/1993 | Bornancini | 42/70.05 |

(Continued)

FOREIGN PATENT DOCUMENTS

| | | |
|---|---|---|
| DE | 3808102 | 10/1989 |
| DE | 453654 | 12/1997 |
| EP | 0751366 | 1/1997 |

OTHER PUBLICATIONS

Combat Handguns, Jun. 2002, cover and "all About the Glock Lock," pp. 10-13.
Combat Handguns, Aug. 2000, cover and "Gun Safety Roundup," D.K. Pridgenpp. 64-67.
Combat Handguns, Mar. 2001, p. 91 (showing "keyed internal locking device").

(Continued)

*Primary Examiner*—Michelle Clement
(74) *Attorney, Agent, or Firm*—Duane Morris, LLP

(57) ABSTRACT

A pistol including a mechanism that locks firing pin of the pistol. The firing pin locking mechanism may include a stopping member which may be selectively moved by a user of the pistol between first and second positions, and a movable blocking member that may be engaged with a forwardly-movable firing pin. A biasing member such as a spring may be provided to bias the blocking member into engagement with the firing pin. In one embodiment, the blocking member arrests or blocks the forward motion of the firing pin to prevent the firing pin from striking a loaded cartridge and discharging the pistol. In a possible first activated position, the stopping member prevents the firing pin blocking member from being operably disengaged from the firing pin, thereby preventing the firing pin from moving forward to strike a cartridge. In a possible second deactivated position, the stopping member allows the firing pin blocking member to be disengaged from the firing pin by normal operation of the pistol trigger system to allow the pistol to be discharged. The firing pin locking mechanism may further include a locking member to allow a pistol user to lock the stopping member in the first position or second position.

19 Claims, 26 Drawing Sheets

U.S. PATENT DOCUMENTS

| | | | | |
|---|---|---|---|---|
| 5,402,593 | A | 4/1995 | Lenkarski et al. | 42/70.06 |
| 5,426,881 | A | 6/1995 | Ruger | 42/70.08 |
| 5,517,780 | A | 5/1996 | Haber et al. | 42/70.08 |
| 5,570,527 | A | 11/1996 | Felicci | 42/70.08 |
| 5,581,927 | A | 12/1996 | Meller | 42/70.11 |
| 6,173,518 | B1 | 1/2001 | Oberst | 42/70.06 |
| 6,212,812 | B1 | 4/2001 | Aigner | 42/70.06 |
| 6,240,670 | B1 | 6/2001 | Findlay | 42/70.08 |
| 6,256,917 | B1 | 7/2001 | Findlay | 42/70.06 |
| 6,256,918 | B1 | 7/2001 | Szabo | 42/70.08 |
| 6,256,919 | B1 | 7/2001 | Brazeau | 42/70.11 |
| 6,256,920 | B1 | 7/2001 | Olson | 42/70.11 |
| 6,260,298 | B1 | 7/2001 | Bubits | 42/70.08 |
| 6,338,217 | B1 | 1/2002 | Viani | 42/70.08 |
| 6,347,538 | B1 | 2/2002 | Doiron | 70/58 |
| 6,389,728 | B1 | 5/2002 | Lundy | 42/70.11 |
| 6,405,473 | B1 | 6/2002 | Petig et al. | 42/84 |
| 6,418,653 | B1 | 7/2002 | Bowles | 42/66 |
| 6,438,886 | B1 | 8/2002 | Neumann | 42/70.11 |
| 6,463,689 | B1 | 10/2002 | McElroy | 42/70.08 |
| 6,487,804 | B1 | 12/2002 | Petrella, Jr. | 42/70.11 |
| 6,510,639 | B2 | 1/2003 | McMoore | 42/70.06 |
| 6,510,641 | B1 | 1/2003 | Viani | 42/70.08 |
| 6,513,273 | B2 | 2/2003 | da Silveira | 42/70.08 |
| 6,519,888 | B1 | 2/2003 | Oberst | 42/70.11 |
| 6,523,294 | B2 | 2/2003 | Curry et al. | 42/66 |
| 2001/0022131 | A1 | 9/2001 | Moczijdlower et al. | 89/155 |
| 2001/0037596 | A1 | 11/2001 | Salvitti | 42/70.08 |
| 2002/0194762 | A1 | 12/2002 | Cominolli | 42/70.06 |
| 2005/0011099 | A1* | 1/2005 | Kiesel et al. | 42/70.08 |

OTHER PUBLICATIONS

Handguns, Dec. 2000, p. 57.
American Rifleman, Jul. 2001, p. 73.
Guns & Ammo, Mar. 2002, p. 70.
Handguns, "Guns & Gear," Oct. 2002, p. 51.
Gun World, Aug. 2003, p. 63-64.
Handguns, Sep. 2001, p. 53.
Combat Handguns, Mar. 2001, Alchemy Arms .45 ACP All-New Spectre, pp. 18-22, 90.
American Rifleman, "Dope Bag Data & Comment," Aug. 2000, p. 62.
Guns Illustrated, 2002, "Gunmaking in the 21st Century," by Bob Hausman, cover and pp. 11-14.
Guns & Weapons for Law Enforcement, "The Guns of Springfield," by Dan Goodwin, pp. 34-36.
Shooting Times, Jan. 2002, "S&W's New Internal Locking System" p. 36.
Guns Illustrated, 2002, 34th Annual Edition, cover, p. 34, and Advertisement: Springfield's Integral Locking System.
Guns Magazine, Aug. 2002, p. 50.
Shooting Times, Aug. 2001, p. 60.
Combat Handguns, New Steyr S Series 9 mm), cover & pp. 10-12.
Combat Handguns, Mar. 2002, "New Steyr "M" .357SIG," pp. 48-49.
Women & Guns, "Taurus Lock Gun," Mar.-Apr. 1998, pp. 44-45.
Shooting Times, Feb. 1998, pp. 43-44.
Gun World, Apr. 2001, "Springfield Ultra-Compact," pp. 38-41.
American GunSmith, "Springfield Armory's Integral Locking System," Oct. 2001, p. 21.
Shooting Times, Jun. 2001, p. 44.
Handguns, "firing Line Report-Walter P22," Phil Johnston, May 2002, pp. 50, 52.
AFTE Journal, vol. 26, No. 4, "Passive Safety Lock for Smith & Wesson Pistols," Oct. 1994 pp. 283-285.
Complete Book of Autopistols 2002, pp. 37-38.
Shot Business, "Smarter Handgun Locks," Jul./Aug. 2002, p. 50.
Women & Guns, Mar./Apr. 2002, p. 35.
Hand Guns, "Firing Line Report-Taurus PT911," Phil Johnston, Jun. 2001, "Taurus PT911," p. 48.
Combat Handguns, Feb. 2002, "New Taurus PT-145 .45ACP," by Mike Boyle, cover & pp. 40-42.
American Handgunner, "Combat Shooting," Dave Anderson, May/Jun. 2003, p. 34.
Gun Tests, "Smith & Wesson 4566TSW .45 ACP," May 2001, p. 6.
Combat Handguns, Sep. 2002, "Gun Safety & Security," by D.K. Pridgen, cover and pp. 66-69 and 96.
Combat Handguns, Jun. 2001, by D.K. Pridgen, "Safety in New Orleans," cover and pp. 48, 50.
Combat Handguns, Sep. 2003, "Buyers Guide-Gun Safety 2003," pp. 42-45, 88.
Gun World, Apr. 2001, "Bond", pp. 66-68.
Gun Tests, Shotguns, "Remington 11-87 Premier 20 gauge No. 9591,"Oct. 2001, p. 26.
The New Gun Week, "Industry News-SHOT Show 2001, Remington's CEO Encourages Activism, Unveils New Products," by Robert M. Hausman, Feb. 20, 2001, p. 3.
Shooting Sports Retailer, Jan. 2001, pp. 40-42.
Gun World, Feb. 2001, pp. 28-29.
Shooting Times, Jan. 2004, "Remington's .17 HMR Model 597 Magnum-Simplicity, Ruggedness & Practicality," pp. 70-72.
Shooting Illustrated, Apr. 2002, p. 55.
Gun Buyer's Annual 2002, "Remington's M700 VLS .223," p. 14.
The Complete Book of Guns 2002, "New Sako 75 Finnlight .308," p. 6.
Gun World, Oct. 2002, p. 38.
The New Gun Week, "Sako Hunter with Keyed Bolt Unlikely to Disappoint Hunters," Sep. 20, 2003, p. 12.
Guns & Ammo, Jul. 2002, p. 51.
Guns & Ammo Apr. 1970, "Savage's Lockable Guns," p. 38.
The Complete Book of Guns 2002, (S&W revolver internal locking mechanism), p. 47.
Guns Magazine, Sep. 2002, pp. 44-45.
The New Gun Week, Oct. 20, 2002, "The S&W 360PD Ends up With High Endorsement by Author," p. 12.
Gun World, "Magnums," Oct. 2003, p. 42.
Gun World, "Hot New Magnums from Smith & Wesson!," Oct. 2003, p. 3.
Women and Guns, Jul.-Aug. 2002 (S&W revolver) pp. 31-32.
Women and Guns, Mar.-Apr. 2002 (S&W revolver) pp. 17-18.
Guns Magazine, Jan. 2002, p. 65.
Guns Magazine, "Tool for Parents," Mar. 2003, p. 45.
Handguns, "Eight is Enough," Feb./Mar. 2003, pp. 68-69.
Guns & Weapons for Law Enforcement, Oct. 2002, "Armory V-16 .45ACP," cover & pp. 50-52.
Shooting Times, Aug. 2001, p. 61.
Sportsman's Gun Annual 2003, "Double-Deuce Triple Play," p. 84.
American Rifleman, "Dope Bag," May 1998, p. 47.
Gun Tests, "Taurus Model 85 UL," Dec. 1997, p. 13.
Gun World, Taurus Security System, Feb. 1998, pp. 79-80.
The New Gun Week, "New Products at SHOT includes 2nd and 3rd Generation Designs," Mar. 10, 2001.
Combat Handguns, Feb. 2001, "New Taurus Tracker .41MAG," by Frank James, cover & pp. 10-12 & 90.
The New Gun Week, "Muzzlebreak on Stellar Tracker Makes It a Noisy Handgun," Aug. 1, 2002, p. 9.
Gun World, "Taurus," Feb. 2003, p. 10.
Gun World, "Taurus," Jun. 2002 p. 76.
American Hunter, "Taurus Model 62," Jan. 2002, p. 65.
Handguns, Feb. 2001, p. 55.
Gun World, "Encore," Oct. 2002, p. 29.
Handguns 2003,". . . 22LR," p. 37 (Walther P-22).
Guns Magazine, "Gun Locks & Security Devices," Roy Huntington, Feb. 2001, pp. 58-59.
AFTE Journal, Apr. 1980, vol. 12, No. 2, "A Semi-Automatic Carbine With A Unusual Safety Device", Donald L. Gunnell, pp. 30-31.
Shooting Times Quarterly, Summer/1989, "What's New?," by J.B. Wood, cover & pp. 56-58.
American Rifleman, Mar. 1993, "Star Megastar 45 Pistol," p. 67.
American Rifleman, Sep. 1981, "Astra A-80 Pistol," pp. 60-61.
Guns, Jun. 1991, .380 Backups from Beretta, by James E. Fender, pp. 68-70.

Shooting Times, Dec. 2000, p. 70 (Taurus PT 145).
Petersen's Handguns Sep. 1990, "Guns for the Future:," by Dave Arnold, article title pages (2) and pp. 48-55.
Advertisement: Smith & Wesson "Where safety is always on duty," 1 page (source and publication date unknown).
Beeman/Agner (model M80), p. 16 (source and publication date unknown).
Advertisement: Beretta B-Lok 9000S (source and publication date unknown).
H&R Revolver (date and publication unknown).
Article: "Integral Locking System," Wiley Clapp (source and publication date unknown).
American Handgunner, Shutzen Der Walthers (discussing Walther P22) (publication date unknown).
Advertisement: USP Compact Pistols (source and publication date unknown).
Combat Handguns p. 49 (publication date unknown).
Rifle 198, p. 26 (publication date unknown).
Shooting Times, Shooting: Worth a Look, "Remington's New Integrated Security System" (publication date unknown).
Advertisement: "Experience a new Era in Rifle Security: The Sako key Concept," (source and publication date unknown).
Advertisement (Sako): "What's So Great About Blocking the Firing Pin?," (source and publication date unknown).
Unknown publication, "From Savage for 1970-Rifle Features Key Lock," Friday, Mar. 13, 1970, p. 6.
Combat Handguns, "Two New S&W .357s," p. 27-28 (publication date unknown).
Article: "Raging Bull," G. Sitton, (source and publication date unknown).
Advertisement (Taurus): ".45 ACP to the Tenth Power . . . Plus One," (source and publication date unknown).
Unknown publication, 55th Ed., 2001, p. 121.
"A Tale of Two Trackers," Denis Prisbrey, pp. 11-15 (source and publication date unknown).
Advertisement for Para, "Safest, Smallest, Smoothest .45!," (source and publication date unknown).
"New Steyr M 9mm/.40," (source and publication date unknown).
American Rifleman, "Star Model 28 9 mm Pistol," p. 62 (publication date unknown).

* cited by examiner

FIG. 8
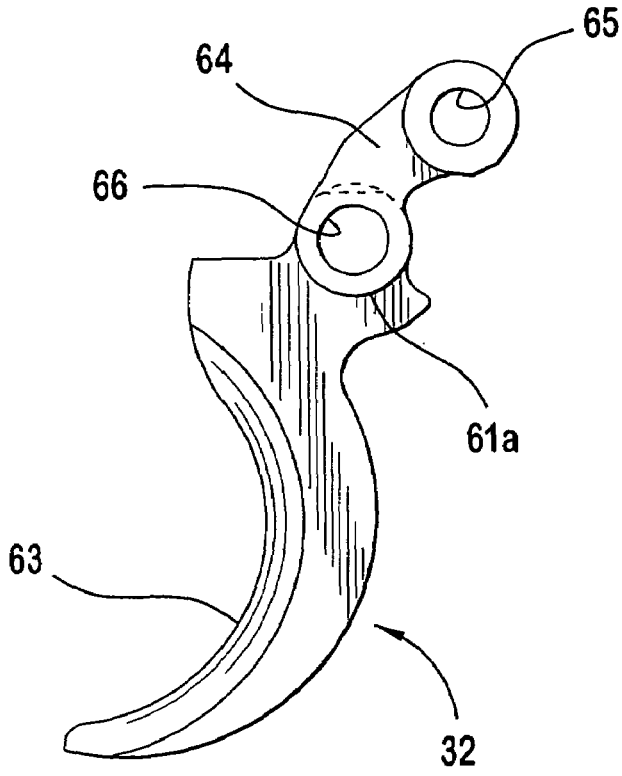
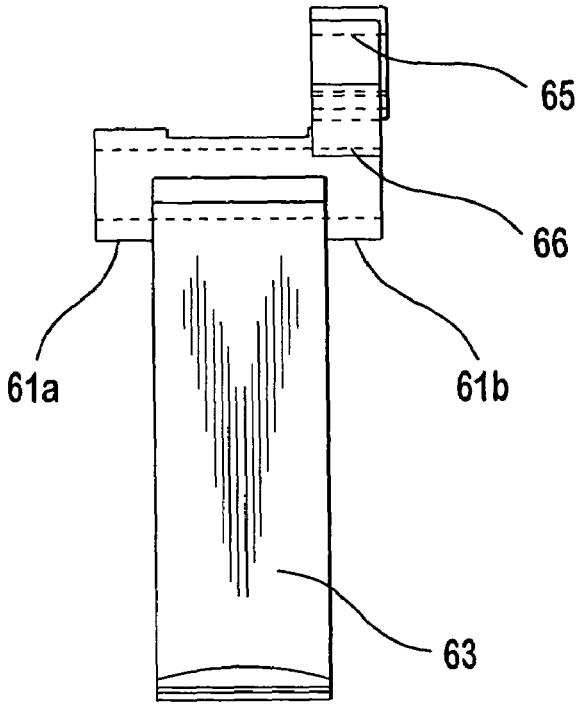
FIG. 8A

FIG. 20A
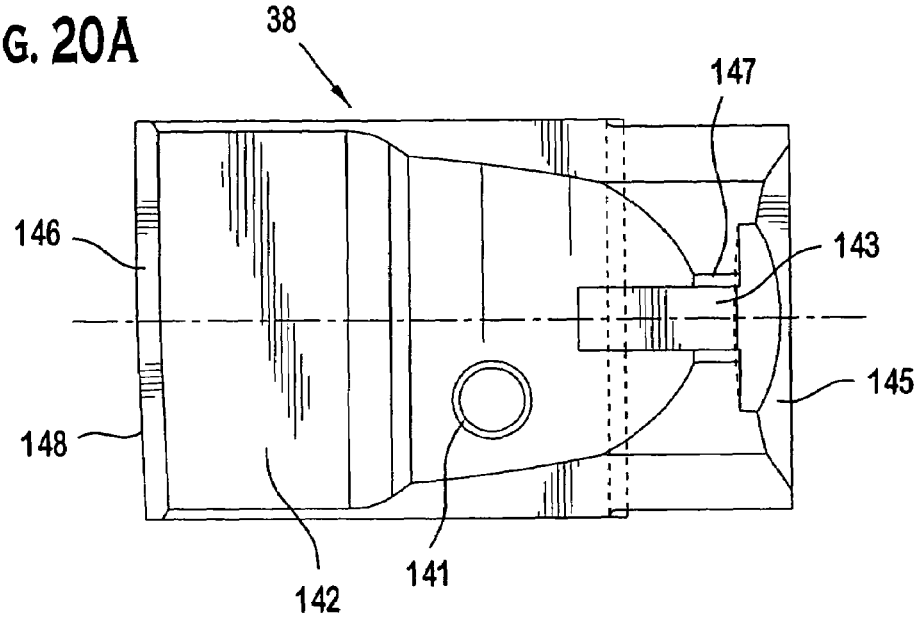
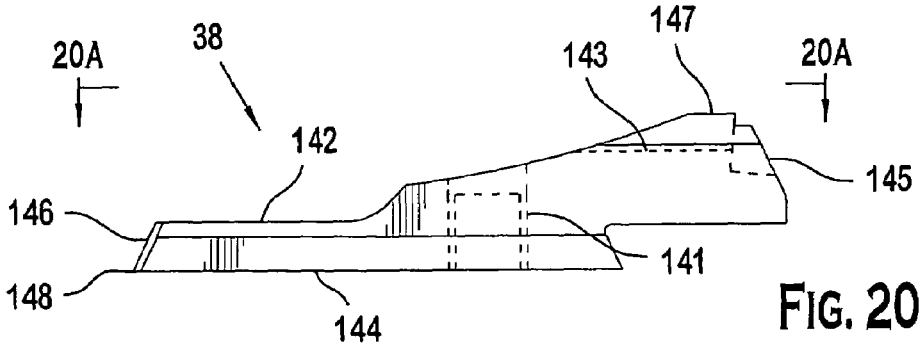
FIG. 20
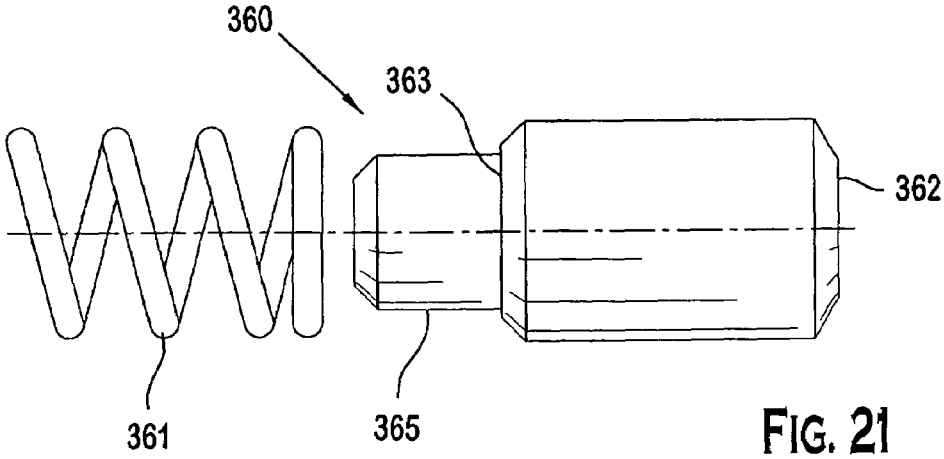
FIG. 21

20
22
38
130
190
195
220
224
229
251
252
260
264
265
270
280
353
360
361
364
G2
210a
210b
222
223
225
231
244
245
262
291a
291b

PISTOL WITH FIRING PIN LOCKING MECHANISM

BACKGROUND OF THE INVENTION

The present invention generally relates to firearms, and more particularly to a mechanism related to locking the firing pin of a pistol.

Prior devices for pistols are known that engage and arrest the forward movement of the firing pin so that it cannot strike a cartridge loaded in the chamber without pulling the trigger. In one type of known device, a spring-biased pin or plunger is provided that moves in a reciprocating manner into and out of engagement with the firing pin. When in a blocking position and absent a trigger pull, the device is spring-biased into engagement with the firing pin to prevent it from being moved forward and striking the cartridge. When the trigger is pulled to discharge the pistol, a mechanical release moves the device against the spring force to a position disengaged from the firing pin. The firing pin may now freely move forward in response to being struck at the rear by the hammer to strike a loaded cartridge and discharge the pistol. Releasing the trigger automatically re-engages the device with the firing pin.

These prior spring-biased devices rely primarily upon the biasing force of the spring to maintain engagement of the device with the firing pin. These automatic devices, however, do not provide a pistol user with the ability to manually lock the device in the blocking position engaged with the firing pin. Although optimal methods to secure a pistol to prevent inadvertent discharge or unauthorized access are to fully unload the pistol and store it in a lockable box, in a safe, or to affix an external lock such as those supplied by most pistol manufacturers, an added measure of precaution can be achieved via a manually-operated supplemental mechanism, that when activated, can physically engage such prior spring-biased devices and lock them into the engaged position even if the trigger is pulled.

SUMMARY OF THE INVENTION

A firing pin locking mechanism for a pistol is provided that includes a stopping member which may be selectively moved by a user of the pistol between first and second positions, and a movable blocking member that may be engaged with a forwardly-movable firing pin to prevent the firing pin from striking a loaded cartridge to discharge the pistol. In a first activated position, the stopping member prevents the firing pin blocking member from being operably disengaged from the firing pin, thereby preventing the firing pin from moving forward to strike a chambered cartridge. In the second deactivated position, the stopping member allows the firing pin blocking member to be disengaged from the firing pin by normal operation of the pistol trigger system to allow the pistol to be discharged. In a preferred embodiment, the same firing pin locking mechanism also provides a trigger block to prevent a user of the pistol from being able to fully pull the trigger rearwards as when discharging the pistol.

A preferred embodiment of a pistol having a firing pin locking mechanism generally includes: a frame; a housing; a chamber defined in the housing to receive a cartridge; a barrel defining a longitudinal axis for the pistol; a firing pin disposed in the housing and movable in a direction along the longitudinal axis to strike a chambered cartridge; a firing pin locking mechanism, and a firing assembly including a trigger, trigger bar, sear, and hammer mechanically coupled together for translated movement. In one embodiment, the housing may further include an external surface and may be a slide that is slidably mounted on the frame and movable in a reciprocating manner in a direction along the longitudinal axis.

The firing pin locking mechanism in the preferred embodiment includes a blocking member and a stopping member movable between at least two positions into and out of engagement with the blocking member. The blocking member is moveable into and out of engagement with the firing pin. A biasing member such as a spring may be provided to preferably bias the blocking member into engagement with the firing pin. When in a position engaged with the firing pin, the blocking member arrests or blocks the forward motion of the firing pin to preferably prevent the firing pin from striking the cartridge and discharging the pistol. In one embodiment, the stopping member is preferably selectively movable in position by a user of the pistol. When in a position engaged with the blocking member, the stopping member prevents the blocking member from being moved out of engagement with the firing pin to prevent the pistol from being discharged. In one embodiment, the stopping member may be configured as an elongated strut.

In another embodiment, the blocking member is moveable in a vertical direction into and out of engagement with the firing pin. In one embodiment, the stopping member may be axially and longitudinally movable into and out of engagement with the blocking member. In yet another embodiment, the stopping member may be movable from a first position in which the stopping member is not engaged with the blocking member to a second position in which the stopping member is engaged with the blocking member to prevent the blocking member from being moved preferably out of engagement with the firing pin. In one embodiment, the blocking member engages the top of the firing pin and is movable vertically upwards and downwards out of and into engagement with the firing pin, respectively. In the same embodiment, the stopping member is moveable to engage the top of the blocking member to prevent the blocking member from being moved vertically upwards into a position out of engagement with the firing pin.

In another embodiment, a pistol with firing pin locking mechanism includes a housing a chamber to hold a cartridge; a firing pin disposed in the housing and movable to strike a chambered cartridge; a blocking member that engages and prevents the firing pin from moving to strike the cartridge; and a stopping member operable to maintain the blocking member into engagement with the firing pin. The blocking member may be movable from a first position in which the blocking member engages the firing pin to a second position in which the blocking member does not engage the firing pin. Preferably, the stopping member may be operable to engage and prevent blocking member movement from the first position to second position. In one embodiment, the stopping member may selectively movable by a user of the pistol into and out of engagement with the blocking member. In another embodiment, a movable selector switch may be connected to the stopping member that allows the pistol user to manually move the stopping member into and out of engagement with the blocking member. In yet another embodiment, the blocking member may be vertically movable and further includes a top surface, and the stopping member further include a bottom surface, the bottom surface of the stopping member movable to engage the top surface of the blocking member when the blocking member is in the first position to prevent vertical movement of the blocking member.

In one embodiment, the stopping member may be operably linked to the trigger through the blocking member and firing assembly. When the stopping member is in the second position and engaged with the blocking member, the trigger is preferably locked into position via the operable linkage to the stopping member, and the trigger cannot be moved substantially by pulling on it as required to discharge the pistol.

In another embodiment, the firing pin locking mechanism may further include a movable selector member that preferably is mechanically connected to the stopping member and controls the movement and position of the stopping member. The selector member is preferably manually operated by a user of the pistol. In one embodiment, the selector member may be a rotatable selector switch that controls the position of the stopping member. Accordingly, the stopping member preferably moves concomitantly with the movement of the selector member. In yet another embodiment, the selector member may be configured as a thumb-lever mechanism that is supported by the pistol housing. At least one thumb-lever is preferably provided. More preferably, the thumb-lever mechanism is a dual or ambidextrous mechanism having two thumb-levers with one thumb-lever preferably being located on either side of the pistol. In one embodiment, the stopping member is pivotally connected to the thumb-lever mechanism such that the rotational movement of the thumb-lever is translated into axial movement of the stopping member. The thumb-lever mechanism may be movable from a first "ready-to-fire" position in which the stopping member does not engage the blocking member to a second "safe" (locked) position in which the stopping member engages and prevents movement of the firing pin blocking member.

According to another aspect of the preferred embodiment, a movable locking member may be provided to keep the stopping member in the second position noted above in which the stopping member is engaged with the blocking member and prevents the blocking member from being moved. Preferably, the locking member is movable between a locked position in which the stopping member is engaged with the blocking member and an unlocked position in which the stopping member is not engaged with and does not prevent movement of the blocking member. In one embodiment, the locking member may be a lock pin that is rotatably movable between the locked and unlocked positions. In another embodiment that includes a selector member that operates the stopping member, the locking member preferably engages and locks the selector member in position to lock the stopping member in a position engaged with the blocking member. Preferably, the locking member is disposed internal to the pistol housing and may be operated by a lock key having shaft that may be inserted through an aperture in the housing to engage and rotate the locking member between its locked and unlocked positions.

In another embodiment, a pistol with firing pin locking mechanism includes a frame; a housing attached to the frame, the housing defining a longitudinal axis and a chamber to hold a cartridge; a firing pin disposed in the housing and longitudinally movable in a forward and rearward direction, at least a portion of the firing pin protruding outwards from the rear of the housing in one position; a movable hammer pivotally mounted in the frame and positioned to physically contact the protruding firing pin to discharge the pistol; a rotary selector switch operably engaged with the firing pin and movable between at least first and second positions, the switch when moved from the first position to second position simultaneously retracting the firing pin within the housing so that the hammer cannot contact the firing pin and discharge the pistol; and a movable locking member that in at least one position engages and holds the switch in the second position so that the hammer cannot contact the firing pin. In one embodiment, the locking member is a lock pin that may be rotatably mounted to the selector switch and configured to receive a cooperatively configured key used by a pistol user to turn the locking member.

A method of blocking firing pin movement in a pistol is also provided, including: engaging a movable blocking member with a firing pin to prevent movement of the firing pin towards a cartridge loaded in a chamber of the pistol; and moving a stopping member into engagement with the blocking member to prevent the blocking member from being disengaged with the firing pin. In another embodiment, the method further includes the step of biasing a movable blocking member into engagement with the firing pin of the pistol. In one embodiment, the method further includes the step of removing the stopping member from engagement with the blocking member to allow the blocking member to be disengaged from the firing pin. In yet another embodiment, the method includes the step of disengaging the blocking member from the firing pin to allow movement of the firing pin towards the cartridge to discharge the pistol.

As the terms are used herein, the "front" of a pistol is defined as the barrel end and the "rear" of a pistol is defined as the handle or grip end. With the barrel positioned parallel to the ground, the term "top" in reference to the pistol is defined as the upper portion generally containing an aiming sight. The term "bottom" in reference to the pistol is defined as the lower portion generally containing a trigger. The "left side" of a pistol is defined as the side visible when the barrel is pointed towards the left and the "right side" is the side visible when the barrel is pointed to the right. Also as the terms may be used herein with respect to orientation using the pistol as a frame of reference to direction, "forward" indicates a direction towards the muzzle (front of barrel) end of the pistol and "rearward" indicates a direction towards the handle or grip end of the pistol. With the barrel positioned parallel to the ground, "downwards" indicates a vertical direction towards the ground and the bottom or underside of the pistol, and "upwards" indicates a vertical direction away from the ground and towards the top of the pistol. "Behind" indicates a location or position to the rear.

Although the preferred embodiment of the firing pin locking mechanism is shown, the preferred embodiment may be beneficially used in other applications where locking the firing pin of a pistol is desired.

BRIEF DESCRIPTION OF THE DRAWINGS

The features of the preferred embodiments will be described with reference to the following drawings where like elements are labeled similarly, and in which:

FIG. 8 is a left side view of the trigger of the pistol of FIG. 1;

FIG. 8A is a front view of the trigger of the pistol of FIG. 1;

FIG. 20 is a left side view of the rear sight of the pistol of FIG. 1;

FIG. 20A is a top view of the rear sight of the pistol of FIG. 1;

FIG. 21 is a side view of the lock detent plunger and plunger spring of the pistol of FIG. 1 useable with the lock pin;

DESCRIPTION OF THE PREFERRED EMBODIMENTS

A preferred embodiment of a firing pin locking mechanism for a pistol will now be described for convenience with reference and without limitation to a centerfire-type pistol in the form of an auto-loading pistol that uses centerfire cartridges (i.e., primer located in center of base of cartridge). It will be appreciated that other embodiments of the firing pin locking mechanism may be made that are suitable for use with other type pistols.

Figure 1:
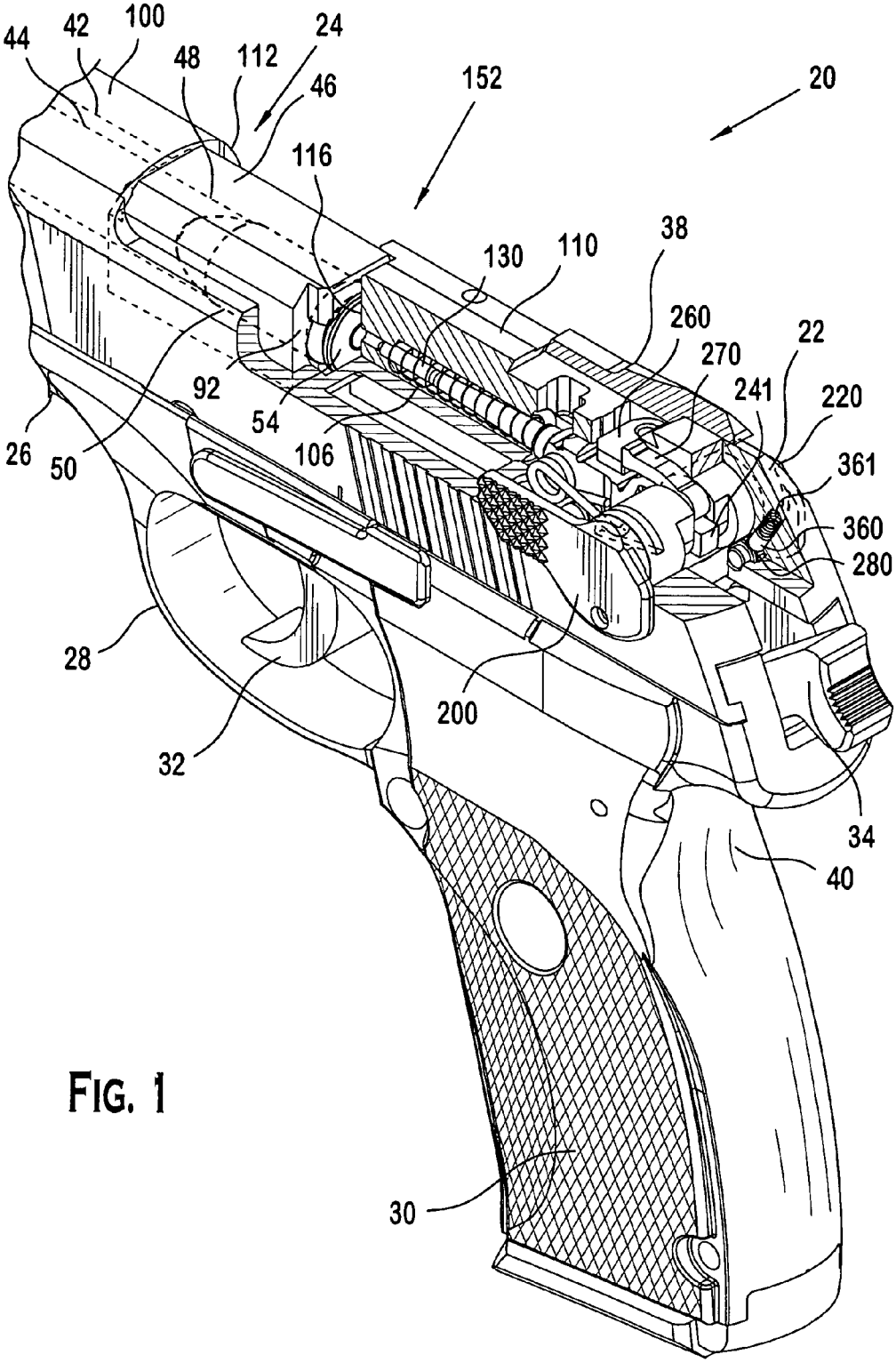
FIG. 1 is a left side perspective view of one embodiment of a firearm in the form of a pistol having a firing pin locking mechanism.
Figures 2, 3:
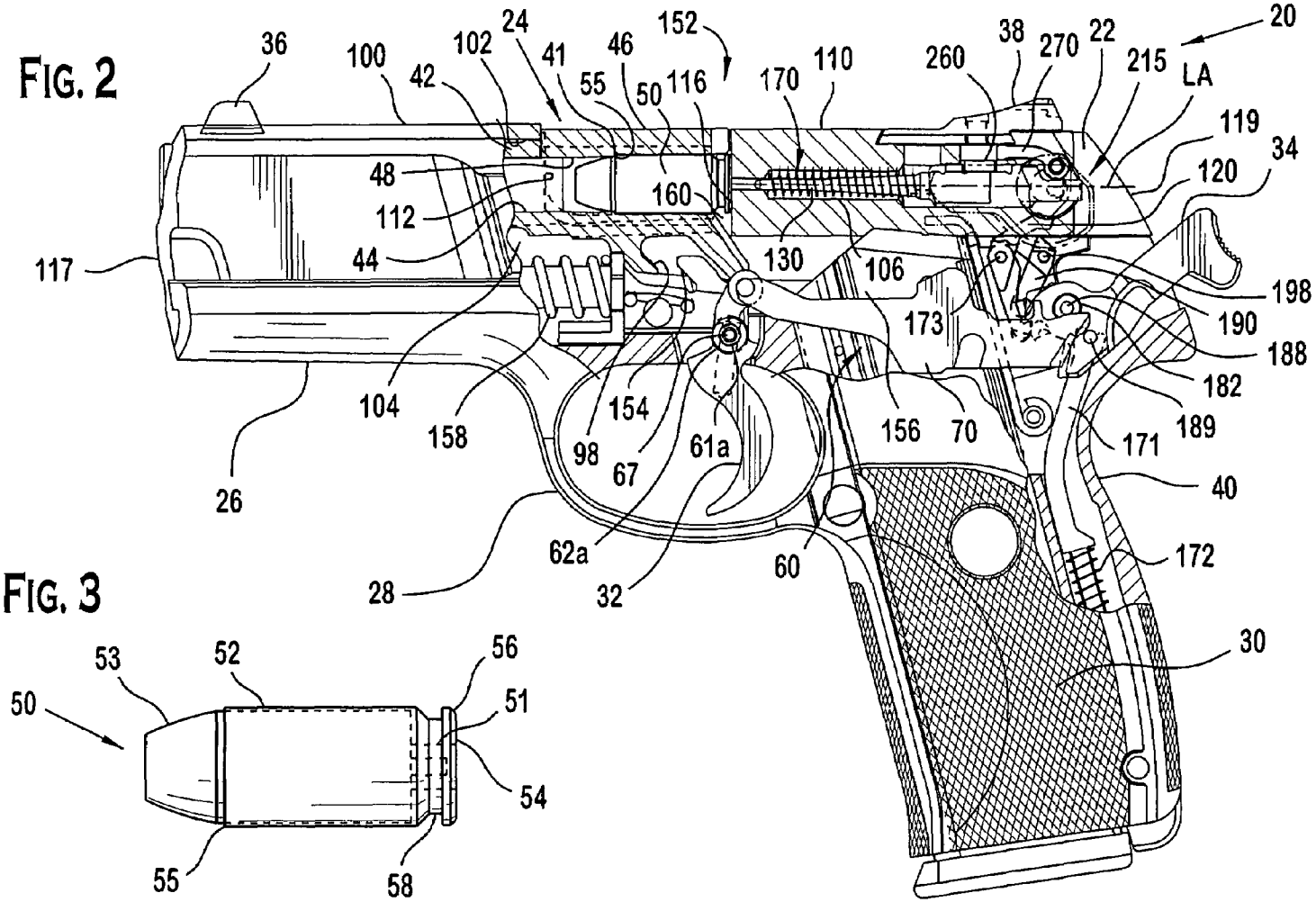
FIG. 2 is a left side cutaway view of the pistol of FIG. 1.
FIG. 3 illustrates a cartridge useable with the pistol of FIG. 1.

Referring particularly to FIGS. 1-2, a pistol 20 generally includes: a housing such as slide 22; a longitudinally-extending barrel unit 24; a frame 26 including a trigger guard 28, grip frame 40 and a hand grip 30 mounted thereon; a firing pin 130; a trigger 32; a hammer 34; a front sight 36; and a rear sight 38. Grip frame 40 may hold a removable magazine 156 with spring-loaded follower which is capable of holding and dispensing a plurality of cartridges for automatic loading of pistol 20.

Figure 7:
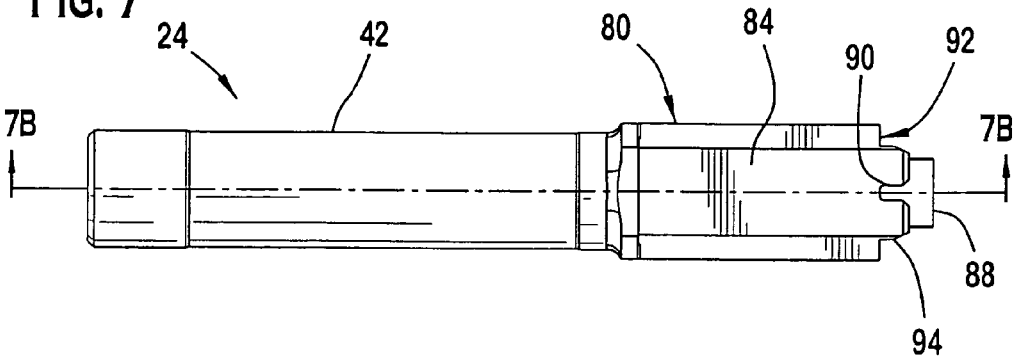
FIG. 7 is a top view of the barrel unit of the pistol of FIG. 1.
Figure 7A:
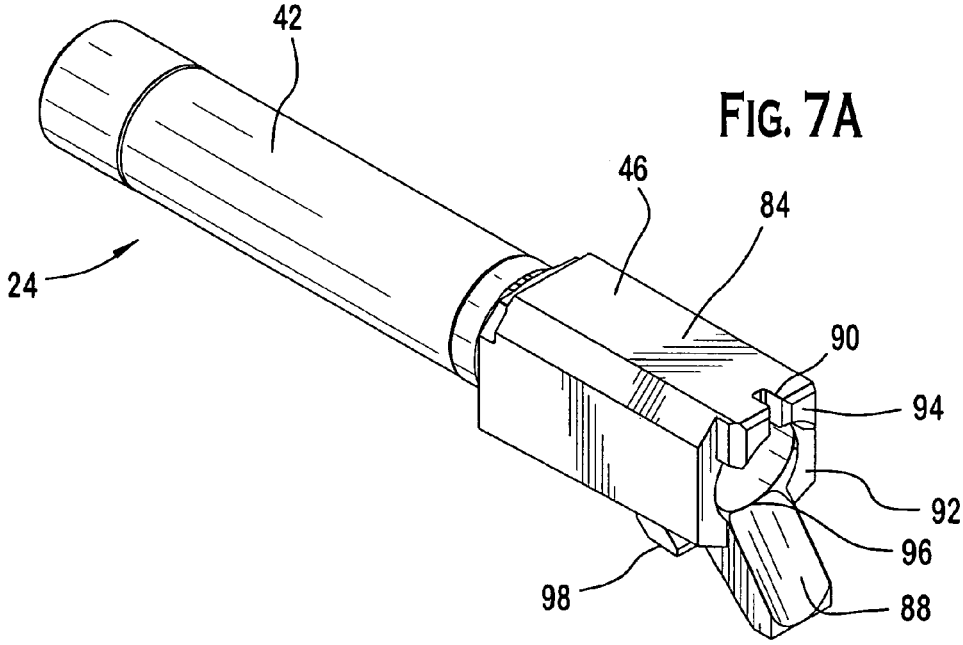
FIG. 7A is a perspective view of the barrel unit of FIG. 1.
Figure 7B:
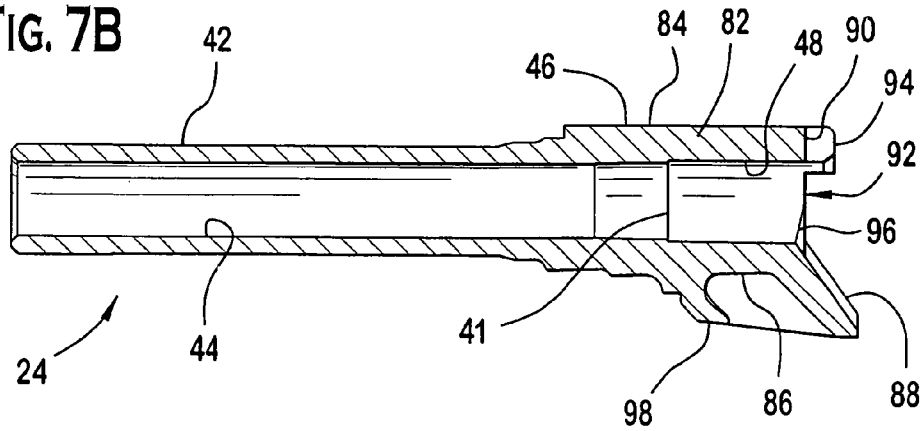
FIG. 7B is a cross-sectional view of the barrel unit of FIG. 1 taken along line 7B-7B in FIG. 7.

With additional reference to FIG. 7, barrel unit 24 includes a barrel 42 having a barrel bore 44 and chamber block 46 at the rear end of barrel unit 24. Chamber block 46 may be integral with barrel 42 or a separate component connected to barrel 42. In one embodiment, barrel unit 24 is preferably disposed at least partially inside slide 22. It will be noted that chamber block 46 may have any suitable overall size and three-dimensional shape (e.g., rectangular or square block, cylindrical, etc.) so long as the chamber block is capable of fitting inside slide 22. In a preferred embodiment, chamber block 46 is rectangular in shape. Chamber block 46 may preferably, but not necessarily, have outside dimensions in cross-section that are larger than barrel 42, as shown.

Chamber block 46 includes a chamber 48 which in a preferred embodiment may be a cylindrical bore that is concentrically aligned with barrel bore 44. Chamber 48 is sized and configured to receive and hold a cartridge 50, which in one embodiment of pistol 20 may be loaded forward in pistol 20 from a magazine 156 in preparation for firing. After firing, the spent cartridge casing is extracted rearwards from chamber 48 and ejected from pistol 20.

Barrel bore 44 and chamber 48 collectively define a longitudinal axis "LA" for pistol 20 passing therethrough along an axial centerline through bore 44 and chamber 48. The term "longitudinal" as used herein indicates in direction parallel to the longitudinal axis LA. A transverse axis "TA" is defined perpendicular to the longitudinal axis LA. The term "transverse" as used herein indicates a direction towards either side of pistol 20 and parallel to the transverse axis TA.

A rearwardly-facing rear breech surface 92 surrounding chamber entrance 96 is provided. Rear breech surface 92 may include an upper rear projection 94 extending rearwardly in a longitudinal direction therefrom and disposed above chamber entrance 96. Upper rear projection 94 serves to provide clearance space 160 between rear breech surface 92 and breech face 116 of slide 22 to accommodate annular rim 56 and extractor groove 58 of cartridge 50 (see FIG. 3).

As best shown in FIG. 3, a cartridge 50 useable with the preferred embodiment may include a casing 52, a projectile 53 disposed in casing 52, a base 54, an annular rim 56 at the base, and an extractor groove 58. Headspace surface 55 at the top edge of casing 52 is stepped in shape and corresponds with a mating step-shaped headspacer 41 in chamber 48 to stop cartridge 50 in a fully-seated position when loaded in chamber 48 (see FIG. 2). Cartridge base 54 may have a primer cup 51 disposed in the center of base 54 which contains the primer material in the case of a centerfire-type cartridge. The primer cup is struck by firing pin 130 to discharge pistol 20. Depending on the specific type of cartridge being used, rim 56 may have a diameter that is smaller than the diameter of casing 52 (reduced or rebated rim cartridge), the same size (rimless cartridge), or larger (rimmed cartridge).

Figure 4A:
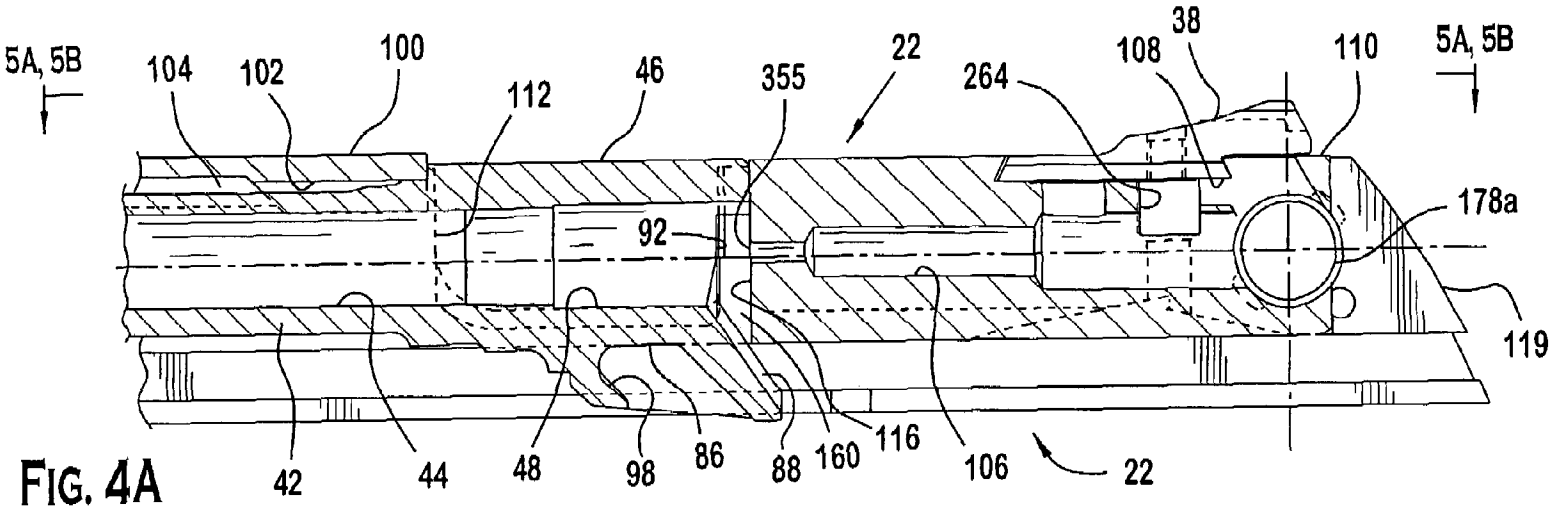
FIG. 4A is a partial left side cross-sectional view of the housing of the pistol of FIG. 1.
Figure 4B:
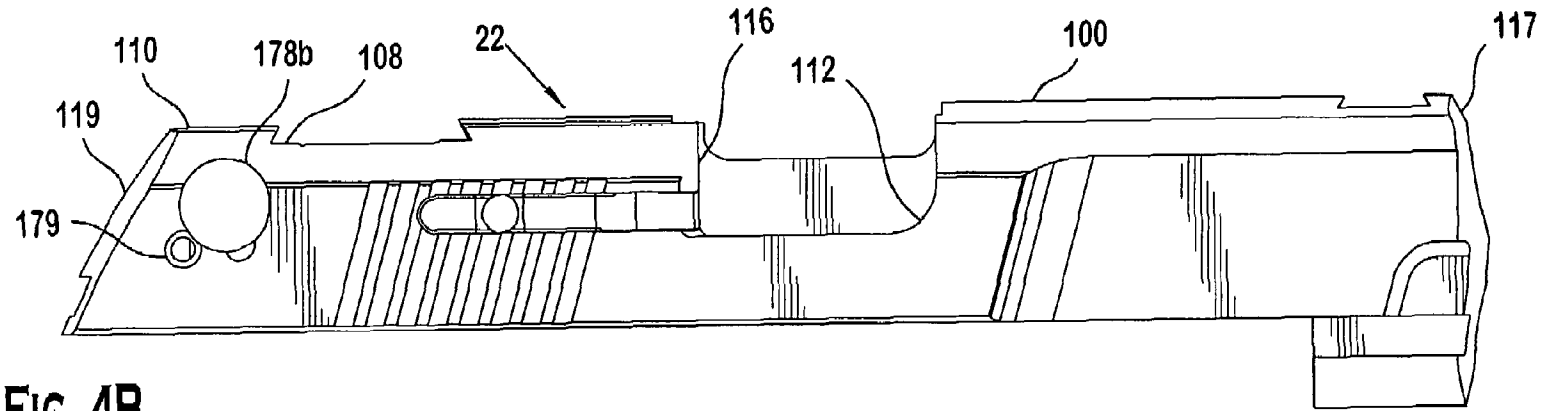
FIG. 4B is a right side view of the housing of the pistol of FIG. 1.
Figure 5A:
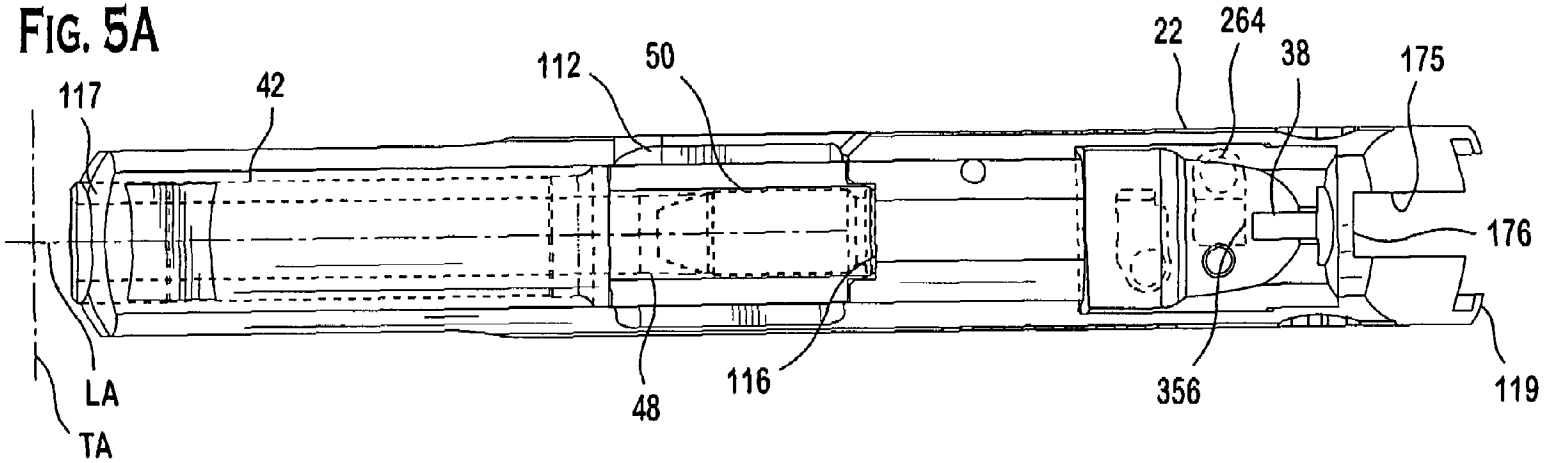
FIG. 5A is a top view of the housing of FIG. 1 taken along line 5A-5A in FIG. 4A.
Figure 5B:
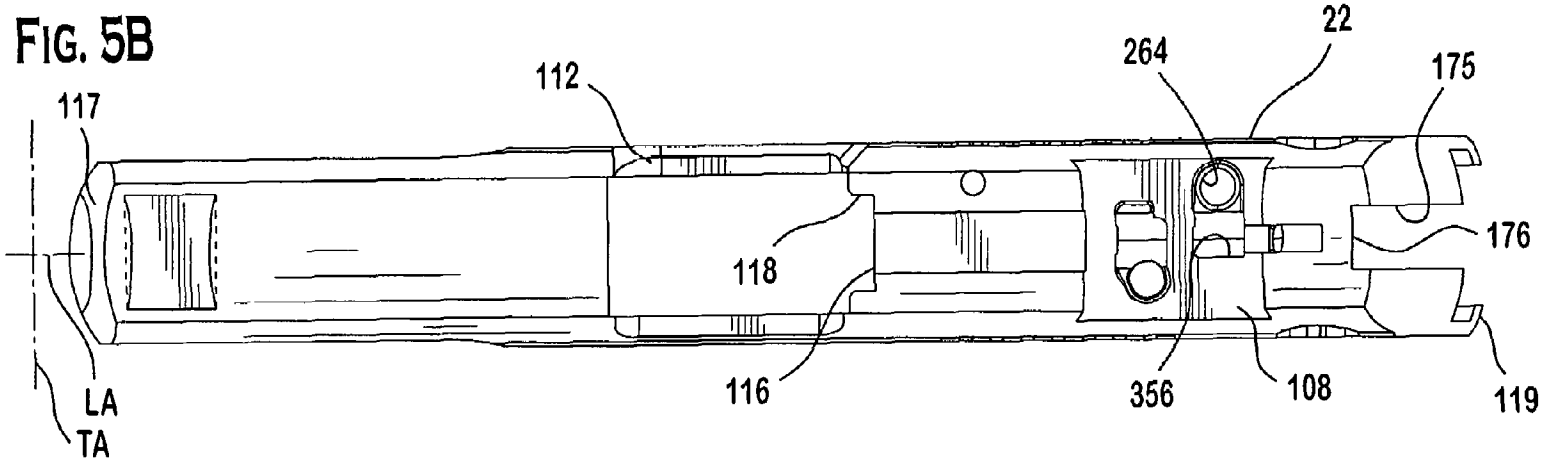
FIG. 5B is a top view of the housing of FIG. 1 taken along line 5B-5B in FIG. 4A with the rear sight removed.
Figure 6:
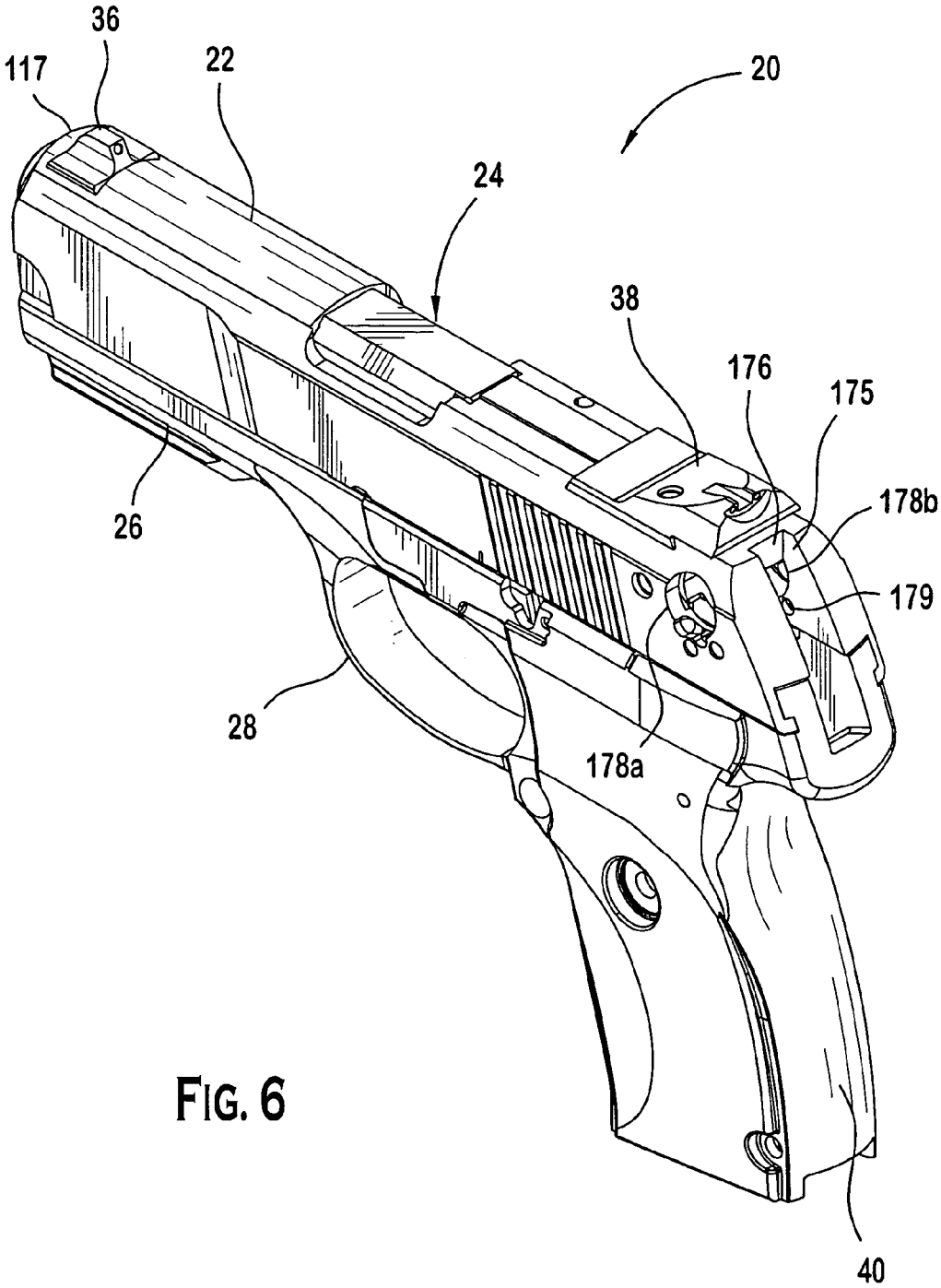
FIG. 6 is left side perspective view of the pistol of FIG. 1 primarily showing the frame and slide with the thumb-levers, trigger, and hammer removed.

With additional reference to FIGS. 4-6, slide 22 has a front end 117 (barrel end) and a rear end 119 (hammer end). In one embodiment, slide 22 in may be slidably mounted on frame 26 via a rail system (not shown) and is biased in a forward direction preferably by a recoil spring 158. Slide 22 slidably reciprocates in a forward and rearward axial direction in response to recoil forces developed in discharging pistol 20 and the spring return force. During its rearward motion, slide 22 permits a spent cartridge casing 52 (i.e., after discharging pistol 20) to be ejected and a new cartridge 50 to be uploaded from the magazine. A new cartridge 50 is loaded into the chamber by slide 22 during its forward return motion.

Slide 22 may be partially hollow in structure and include a plurality of external surfaces 100 and internal surfaces 102. In the forward portion of slide 22, internal surfaces 102 define a downwardly-open forward internal cavity 104 to house at least a part of barrel unit 24 which is in operational relationship with slide 22. Preferably, barrel unit 24 is slidably received in slide 22 such that slide 22 and barrel unit 24 may move independently from each other for purposes to be explained below in conjunction with the operation of pistol 20. The rear portion of slide 22 contains a forwardly-facing breech face 116 (see, e.g., FIGS. 4A, 4B, 5A, and 5B) which abuts and supports base 54 of cartridge 50 when the cartridge is loaded in chamber 48. Breech face 116 may have a breech face notch 118 which receives upper rear projection 94 projecting rearwardly from chamber block 46 and above chamber 48, as described above. In conjunction with upper rear projection 94, breech notch 118 serves to close up the area to the rear of chamber 48 when chamber block 46 is positioned in ejector port 112 such as when a cartridge is fully chambered and readied for firing.

Slide 22 may further include an external top surface 110, which constitutes part of slide external surfaces 100, and may extend substantially along the entire length of slide 22. A generally flat and wide horizontal landing surface 108 may be provided near the rear of top surface 110 to mount rear sight 38 on slide 22. An ejector port 112 may also be provided which extends laterally and downwardly through slide 22, and opening into internal cavity 104. When pistol 20 is in the ready position for firing with cartridge 50 loaded in chamber 48 (see, e.g., FIGS. 2 and 6), chamber 48 is visible through and substantially blocks ejector port 112. When slide 22 is forced rearwards by firing pistol 20, ejector port 112 moves beyond chamber 48 and opens allowing a spent cartridge casing to be ejected through port 112.

Slide 22 further includes a firing pin cavity 106 configured to receive firing pin 130. In one embodiment, firing pin cavity 106 preferably is concentrically aligned with and shares longitudinal axis LA and a common centerline passing through the centerline of chamber 48 and bore 44. When cartridge 50 is loaded in chamber 48, this aligns firing pin 130 to strike the center of cartridge base 54 where the primer cup 51 is located to discharge pistol 20 (see FIG. 3). Firing pin cavity 106 may be configured to include several adjoining cavities having different internal diameters to accommodate the shape of firing pin 130 and various appurtenances. The rear of firing pin cavity 106 opens externally through an opening 351 in thumb-lever mechanism 215 to allow rear hammer end 241 of firing pin 130 to be protruded from the thumb-lever mechanism into hammer slot 175 (see FIG. 5) in slide 22 so that firing pin end 241 may be struck by hammer 34 to discharge pistol 20. The front of firing pin cavity 106 has an opening 355 (see FIG. 4A) which allows striking end 240 of firing pin 130 to be protruded outwards from cavity 106 to contact cartridge 50 when struck by hammer 34.

Figure 14A:
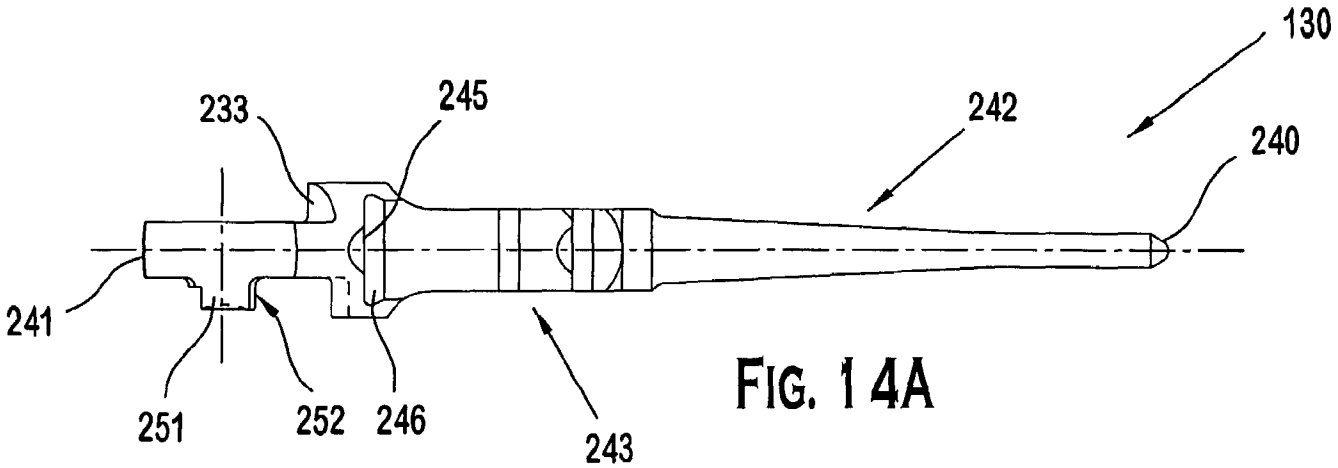
FIG. 14A is a top view of the firing pin of the pistol of FIG. 1.
Figure 14B:
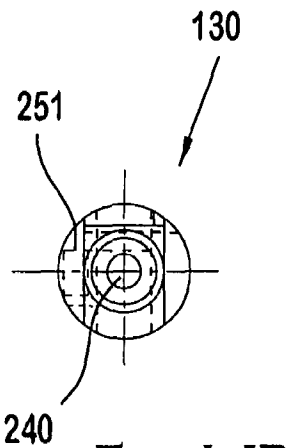
FIG. 14B is a front view of the firing pin of the pistol of FIG. 1.
Figure 14:
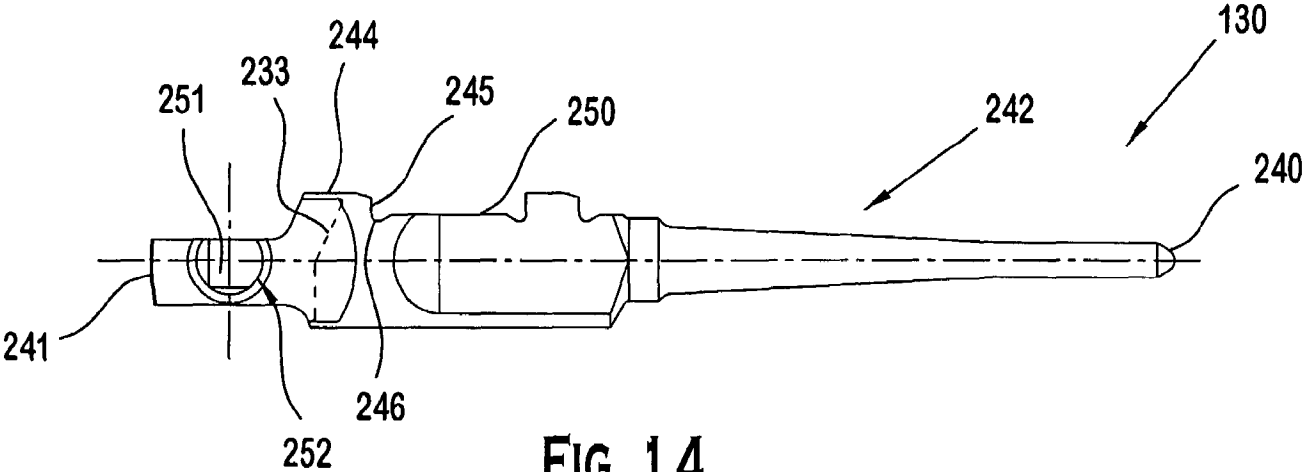
FIG. 14 is a right side view of the firing pin of the pistol of FIG. 1.

Referring specifically to FIGS. 14-14B, firing pin 130 includes front cartridge-striking end 240, preferably culminating in a tip to strike primer cup 51 of cartridge 50, and a rear hammer end 241. In one embodiment as shown, the front portion of firing pin 130 has a generally tapered, cylindrical section 242 transitioning into striking end 240. Rear of cylindrical section 242 is a preferably enlarged section 243 containing top surface 250 which includes upwardly-extending protrusion 244 rising therefrom as shown. Protrusion 244 has a forward-facing vertical surface 245 configured and sized for abutting contact with firing pin block 260 to prevent forward movement of firing pin 130. Preferably, vertical surface 245 is shaped cooperatively with firing pin block 260 to produce a positive blocking relationship between surface 245 and firing pin block 260. In one embodiment, vertical surface 245 may be substantially flat, but other suitable configurations are possible so long as vertical surface 245 positively engages firing pin block 260 to prevent forward movement of firing pin 130. The surface of firing pin 130 may have a laterally-extending undercut at the base and forward of vertical surface 245.

Firing pin 130 further includes a laterally-extending boss 251, preferably disposed in the rear portion of firing pin 130 behind upwardly-extending protrusion 245. Boss 251 is configured and sized to engage right thumb-lever 220, as further explained below. In the embodiment shown, boss 251 further may have a forward-facing curved surface 252 having radius to match corresponding curved surface 221 of right thumb-lever 220 (see FIG. 23A). It will be appreciated that boss 251 may have any suitable shape so long it may be positively engaged by right thumb-lever 220 to impart movement to firing pin 130.

Firing pin 130, preferably disposed in firing pin cavity 106 of slide 22 as noted above, may be biased by a spring 170 in a rearward direction opposite chamber 48. In one embodiment, spring 170 is a helical spring which is preferably coiled around cylindrical section 242 (see, e.g., FIGS. 2 and 14). Firing pin 130 preferably has a longitudinally reciprocating forward stroke and rearward motion, and is mechanically actuated by trigger 32. Hammer 34 is mechanically linked to trigger 32 by a firing assembly 60, as described below. In general, pulling trigger 32 causes hammer 34 to move or drop forward from the "ready-to-fire" position (as shown in FIG. 2) and strike the rear of firing pin 130. Firing pin 130 is forced forward through firing pin cavity 106 against the spring force of spring 170 and strikes the cartridge primer cup to set off the charge and discharge pistol 20.

Referring generally to FIG. 2, firing assembly 60 includes primarily trigger 32, hammer 34, and trigger bar 70. These firing assembly elements are installed in pistol 20 in a position and with an orientation generally as shown in FIG. 2. With additional reference to FIGS. 8 and 8A, trigger 32 is pivotally mounted and supported in frame 26 about pin 67 which is received in frame 26 and passes through trigger pivot hole 66 defining a pivot point. Trigger 32 includes spaced-apart curved trigger support surfaces 61*a*, 61*b* which further support the trigger and are moveably received in mating curved frame recesses 62*a*, 62*b*, respectively, in frame 26 (see FIG. 2). Trigger 32 has an upwardly-extending upper projection 64 which preferably is offset to one side of trigger 32, as shown. Upper projection 64 contains hole 65 which receives laterally-extending projection 74 on the front of trigger bar 70. Preferably, hole 65 is located above the trigger pivot point (i.e., pivot hole 66) so that pulling and rotating trigger 32 rearward causes upward projection 64 with hole 65 to rotate in an opposite direction forward. Trigger bar 70 is preferably biased towards the rear of pistol 20 by a biasing member such as a spring (not shown). Accordingly, pulling trigger 32 in a rearward direction, as in to firing pistol 20, causes trigger bar 70 to move in a forward direction against the spring-force via the interaction of lateral projection 74 with hole 65 of trigger 32.

Figures 9, 9A, 9B:
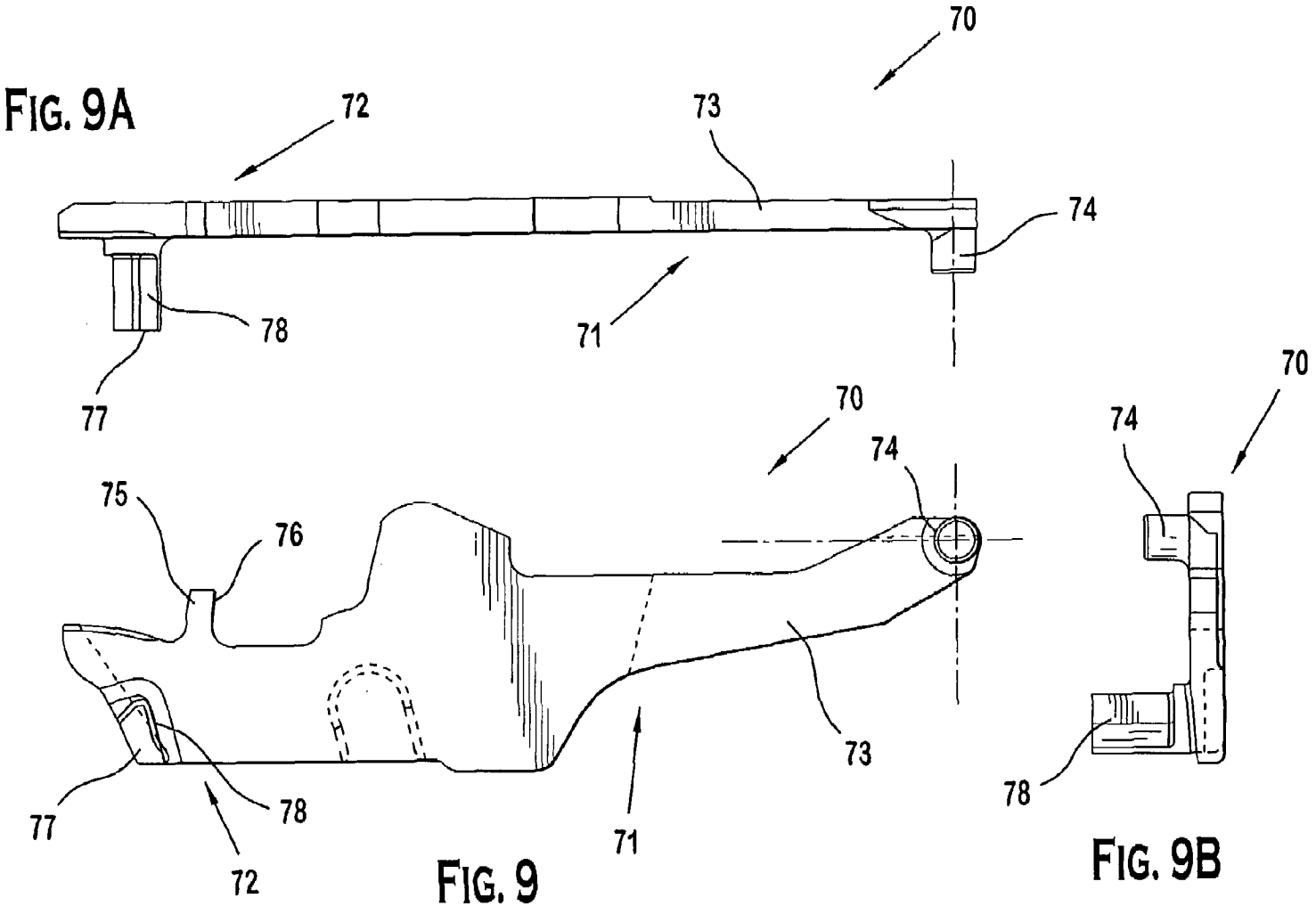
FIG. 9 is a right side view of the trigger bar of the pistol of FIG. 1.
FIG. 9A is a top view of the trigger bar of the pistol of FIG. 1.
FIG. 9B is a front view of the trigger bar of the pistol of FIG. 1.

Trigger bar 70 is preferably slidably received in frame 26 and capable of a reciprocating forward/backward longitudinal axial movement with respect to the frame. With additional reference to FIGS. 9 and 9B, trigger bar 70 may be generally elongate and has a front portion 71 and rear portion 72. Front portion 71 includes a longitudinally-extending projection 73 which contains laterally-extending projection 74. Preferably, lateral projecting is cylindrical, and sized and configured to be received in hole 65 of trigger 32. Rear portion 72 includes upwardly-extending lug 75 having forward-facing and vertical abutment surface 76 which engages and activates laterally-extending protrusion 192 of firing pin blocker-lever 190 (see FIG. 11). Laterally-extending protrusion 77 is provided which projects from rear portion 72 and engages downwardly-extending protrusion 184 of hammer 34 (see FIG. 10). Preferably, protrusion 77 is disposed proximate to the rear and bottom of trigger bar 70 as shown. At least part of protrusion 77 may preferably have a forward-facing planar surface 78 to engage planar surface 185 of hammer protrusion 184.

Figure 10:
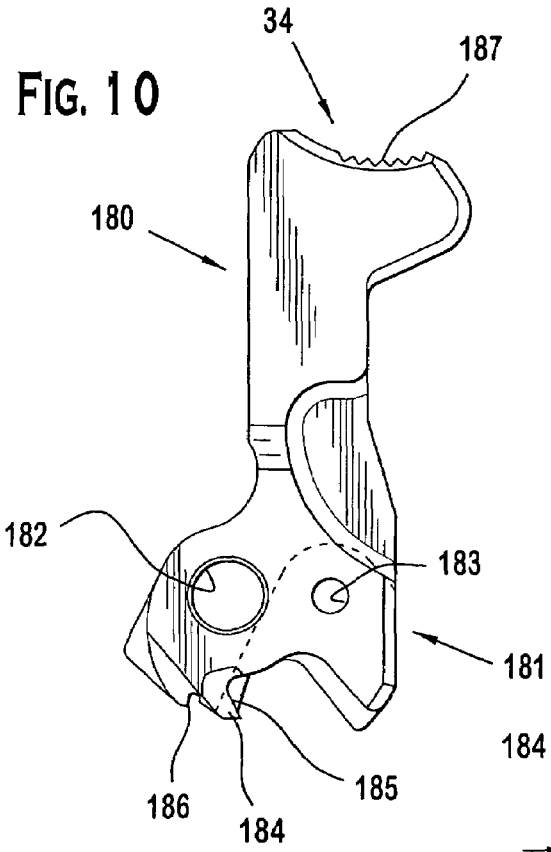
FIG. 10 is a side left view of the hammer of the pistol of FIG. 1.
Figure 10A:
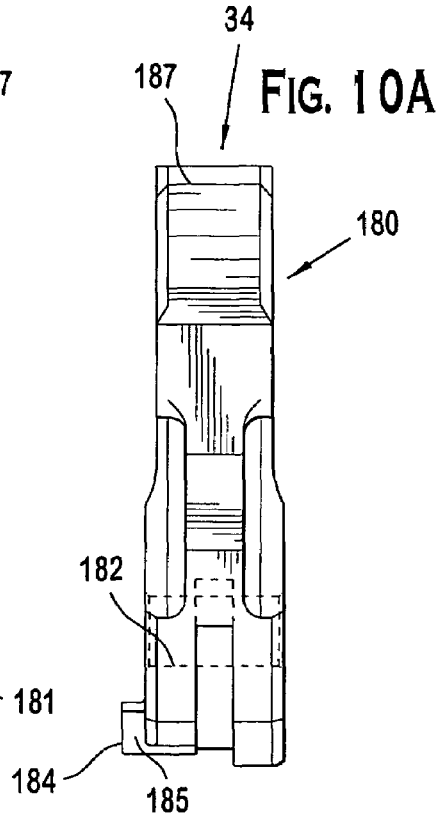
FIG. 10A is a rear view of the hammer of the pistol of FIG. 1.

With additional reference to FIGS. 10 and 10A, hammer 34 includes an upper portion 180 having thumb grip surface 187 and lower portion 181. Hammer 34 is pivotally mounted to frame 26 via pivot pin 188 which extends through pivot hole 182. As shown in FIG. 2, hole 183 receives a pin 189 which engages hammer spring guide 171 having hammer spring 172 to bias hammer 34 in a forward and counter-clockwise direction (when viewed from the left side of pistol 20, as shown in FIG. 2) toward engagement with firing pin 130. Lower portion 181 may include a sear notch 186, which is preferably disposed on the bottom of hammer 34 and opens downward, as shown. Sear notch 186 is engageble with laterally-extending hook 125 of sear 120. Further included in lower portion 181 of hammer 34 is downwardly-extending protrusion 184, which preferably has planar surface 185. As noted above, protrusion 184 is engageable with lateral protrusion 78 of trigger bar 70. This allows a trigger 32 pull to rotate hammer 34 about pin 188, thereby compressing hammer spring 172 and simultaneously cock hammer 34 rearwards, and eventually releases hammer 34.

Figure 15C:
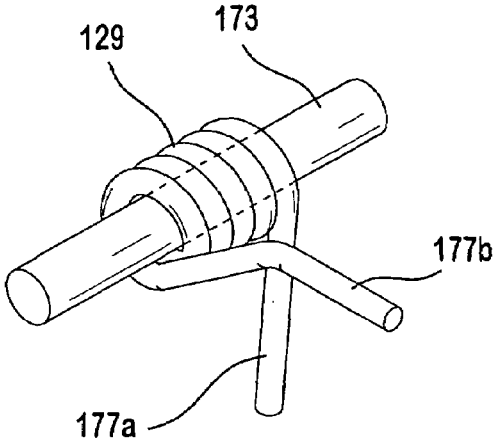
FIG. 15C is a perspective view of the sear pin and spring of the pistol of FIG. 1.
Figure 15B:
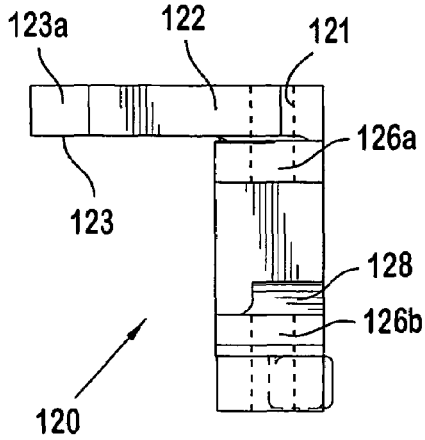
FIG. 15B is a top view of the sear of the pistol of FIG. 1.
Figure 15A:
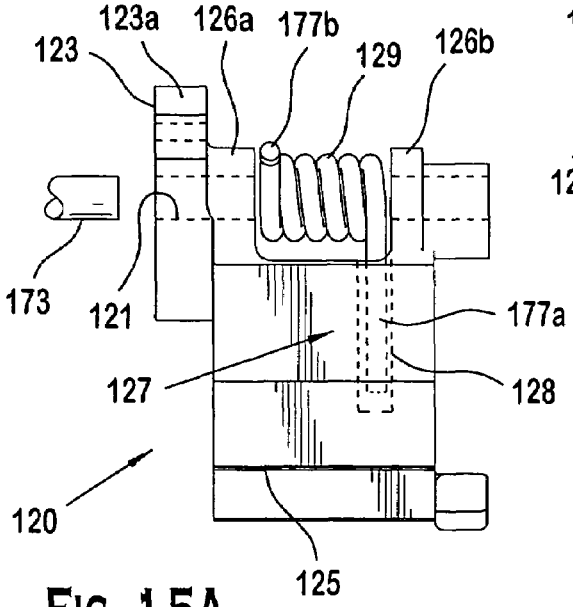
FIG. 15A is a front view of the sear of the pistol of FIG. 1.
Figure 15:
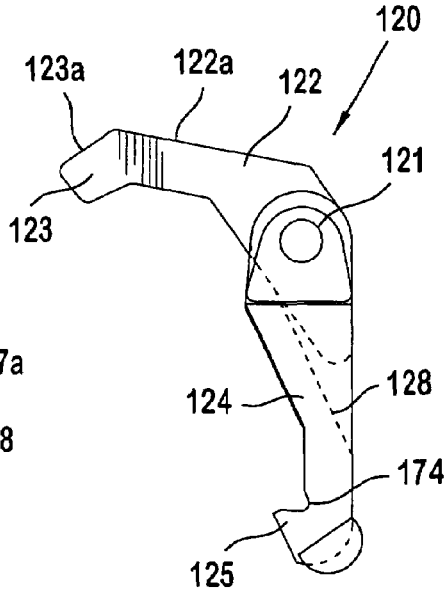
FIG. 15 is a right side view of the sear of the pistol of FIG. 1.

Sear 120, as shown in FIGS. 15-15B, includes main body portion 127 which may have an elongate and preferably rectangular recess 128 disposed on the forward-facing side to receive downwardly-extending leg 177*a* of sear torsion spring 129. FIG. 15C depicts sear spring 129 with legs 177*a*, 177*b*. Rearwardly-extending leg 177*b* of torsion spring 129 is received in slot 197 in firing pin blocker-lever 190, as discussed below. Sear 120 is generally positioned and oriented in pistol 20 as shown in FIG. 2. At the top of main portion 127 are spaced-apart lugs 126*a*, 126*b* through which pivot pin opening 121 extends to pivotally mount sear 120 to frame 26 about sear pivot pin 173 (see FIG. 2). Torsion spring 129 is preferably mounted about pivot pin 173 and disposed between spaced-apart lugs 126*a*, 126*b*, as shown. Attached to one of the lugs 126*a*, 126*b*, preferably the left side lug 126*a*, is rearwardly-extending and elongate sear disengagement lever 122 protruding from sear 120. Sear lever 122 is preferably disposed on the top of sear 120 (as shown) and positioned to engage left thumb-lever 200 (see FIG. 12D) when sear 120 is mounted in pistol 20, as further described below. Sear lever 122 has a top surface 122*a*, a portion of which may engage left thumb-lever 200. In one embodiment as shown, at least part of lever 122 has an angled portion 123 including angled top surface 123*a* disposed adjacent to top contact surface 122*a*. Lever 122 is preferably angled and configured to mate with corresponding angled surfaces 201, 202 of left thumb-lever 200 to allow for positive engagement and seating of sear lever 122 with left thumb-lever 200.

The lower part of sear main body portion 127 preferably includes a laterally-extending hook 125 to engage sear notch 186 of hammer 34 (see FIG. 10). To ensure positive engagement with hammer notch 186, a laterally-extending undercut may be provided in sear body portion 127 adjacent to hook 125. Sear torsion spring 129 biases hook 125 in a rearward and counter-clockwise direction about pivot pin 173 (when viewed from the left side of pistol 20 as shown in FIG. 2) towards engagement with sear notch 186 of hammer 34.

When installed in pistol 20, sear 120 is located forward of firing pin blocker-lever 190. Forwardly-extending lever arm 195 of firing pin blocker-lever 190 may be positioned and occupy the space above and in the vicinity of lug 126*b* (as shown in dashed lines). This help provide a compact, space-saving arrangement of these two components which operably interact as discussed below.

Before further describing aspects of the pistol firing pin locking mechanism and related components of the preferred embodiment, the basic operation of pistol 20 pertaining to firing assembly 60 (see FIG. 2) and its components just described bears brief mention at this juncture. The motion of the firing assembly 60 and orientation will be described with reference to FIG. 2 which depicts pistol 20 in the "ready-to-fire" mode, with hammer 34 in a fully-cocked rearward position and trigger 32 in a partial rearward position. In "double-action firing mode," a user of pistol 20 may discharge the pistol with a single trigger pull starting with hammer 34 in its fully-forward position (not shown) resting against slide hammer stop surface 176 within hammer slot 175 (see, e.g., FIGS. 5A and 5B). As trigger 32 is pulled rearwards by the pistol user, trigger bar 70 slides forward in frame 26 and concomitantly cocks hammer 34 rearwards. Continuing the trigger 32 pull (and simultaneous forward movement of trigger bar 70) engages upwardly-extending lug 75 of trigger bar 70 with protrusion 192 of firing pin blocker-lever 190 which pivotally moves clockwise. After a momentarily lag in time (the significance of which will be described later), firing pin blocker-lever 190 (preferably curved surface 352—see FIG. 11A) contacts sear 120 causing it to pivotally move clockwise which prevents the sear hook 125 from engaging sear notch 186 of hammer 34. Hammer 34 (biased in a forward direction by spring 172) is then released and moves forward to strike rear hammer end 241 of firing pin 130 (see FIG. 14).

With a auto-loading pistol such as pistol 20, a new cartridge 50 may be automatically loaded into chamber 48 from the magazine after discharging the pistol, and the hammer comes to rest in the "ready-to-fire" position shown in the FIG. 2, with sear hook 125 engaging sear notch 186 of hammer 34 and trigger 32 held in a partial rearward position. Pistol 20 may now be discharged in what may be referred to as the "single-action firing mode." Because the hammer is already cocked in starting position (as opposed to double-action mode described above), a full-motion trigger pull is not needed to discharge pistol 20. The trigger pull in single-action mode discharges pistol 20 with the various firing assembly 60 components moving in the same manner described above.

Figure 11A:
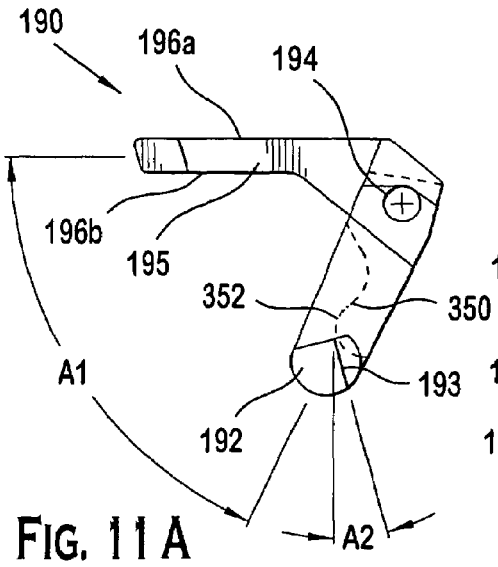
FIG. 11A is a left side view of the firing pin blocker-lever of the pistol of FIG. 1.
Figure 11:
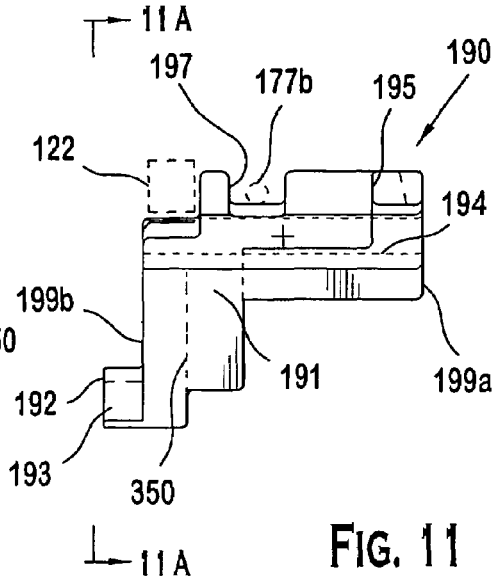
FIG. 11 is a rear view of the firing pin blocker-lever of the pistol of FIG. 1.

Continuing now with a description of the pistol 20 components, and with reference to FIGS. 11-11A, firing pin blocker-lever 190 includes a main body 191, right and left sides 199*a*, 199*b* respectively, and an open passageway 194 extending laterally and completely through main body 191. Passageway 194 receives pivot pin 198 to pivotally mount blocker-lever 190 to frame 26. Main body 191 may be configured as required to accommodate and provide suitable clearances with respect to other components present in pistol 20. An upwardly-open slot 197 may be disposed in the top of main body 191 to receive leg 177*b* from sear torsion spring 129 (shown with dashed lines), which biases blocker-lever 190 in a counter-clockwise and downward direction (when viewed from the left side of pistol 20, as shown in FIG. 2).

Blocker-lever 190 includes forwardly-extending and elongated lever arm 195 that is capable of engaging firing pin block 260, as further described below. Lever arm 195 may include top and bottom surfaces 196*a*, 196*b*, respectively. Preferably, top surface 196*a* is configured and positioned to make contact with and lift pin block 260 when both components are mounted in pistol 20. Lever arm 195 is preferably disposed at the top of main body 191 and may be offset to one side (preferably, right side 199*a* of blocker-lever 190 as viewed in FIG. 11-11A). In the preferred embodiment, lever arm 195 is disposed at an angle A1 to main body 191 of blocker-lever 190 as shown. Preferably, angle A1 is less than or equal to 90 degrees, and in one embodiment may typically be about 64 degrees.

Disposed near the bottom of blocker-lever 190 is protrusion 192, as noted previously, which extends in a lateral direction. Protrusion 192 preferably is configured and arranged on blocker-lever 190 to make operable contact with protrusion 75 of trigger bar 70 when both components are mounted in pistol 20. In the embodiment shown, at least a portion of blocker-lever protrusion 192 has a generally rounded shape in cross-section, preferably on its front and lower quadrants (see FIG. 11A). The rear half of protrusion 192 is preferably flat and disposed at an angle A2 with respect to the vertical plane to mate with flat surface 76 of protrusion 75 on trigger bar 70. In one embodiment, angle A2 is about 15 degrees. It will be appreciated that protrusion 192 may have any suitable configuration and arrangement that compliments protrusion 75 of trigger bar 70 so long as positive operable contact between the components may be made.

When trigger 32 is pulled to discharge pistol 20, trigger bar 70 slides forwards causing protrusion 75 on trigger bar 70 to engage protrusion 192 on blocker-lever 190. This engagement rotates blocker-lever 190 in a clockwise direction (when viewed in FIG. 2), causing lever arm 195 to concomitantly rotate upwards and contact the bottom 269 of firing pin block 260 (see FIG. 16). Lever arm 195 displaces firing pin block 260 upwards, which in one embodiment places firing pin block flange 262 in a non-blocking position with respect to the forward movement of firing pin 130, further described below.

Firing pin blocker-lever may further have a curvilinear-shaped raised area 350 as shown best in FIG. 11A to engage sear 120 in the manner discussed above. In one embodiment, raised area 350 may have a forward-facing curved surface 352 to make contact with sear 120 in a smooth fashion. When sear 120 and firing pin blocker-lever 190 are installed in pistol 20, sear disengagement lever 122 which extends in a rearward direction may conveniently occupy an area at the top of firing pin blocker-lever 190 above top left side 199*b* as shown in dashed lines.

Pistol 20 may further have an ambidextrous thumb-lever mechanism 215 which includes left and right thumb-levers 200, 220 respectively which are pivotally mounted through external holes 178*a*, 178*b* (see FIGS. 4A, 4B) located towards the rear of slide 22. In the preferred embodiment, thumb-levers 200, 220 are mechanically linked together as further described below and therefore rotate in unison. The thumb-levers are operated and activated by pressure applied with a pistol user's thumb. The thumb-lever mechanism functions generally to prevent discharging pistol 20 by a trigger pull, and as a mechanism to decock hammer 34 from the "ready-to-fire" to "safe" position while preventing discharge of the pistol.

Figure 12:
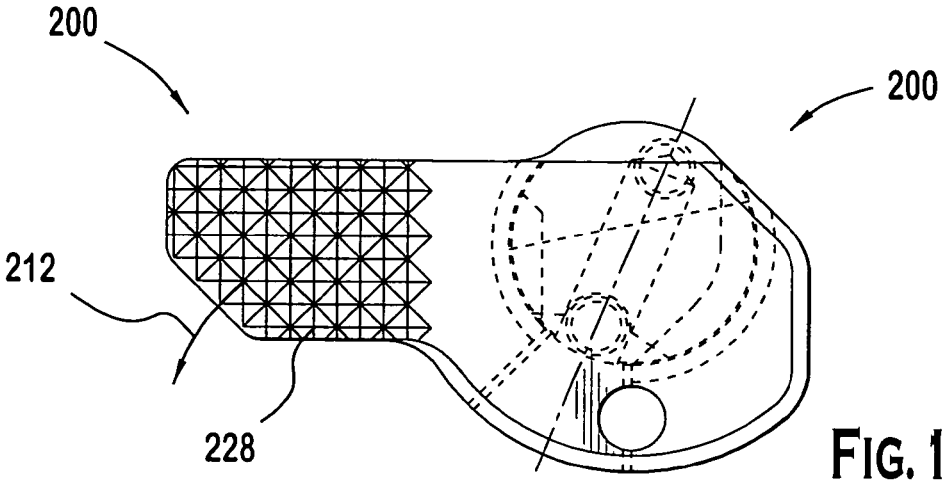
FIG. 12 is a left side view of the left thumb-lever of the pistol of FIG. 1 as seen when mounted in the housing of the pistol.
Figure 12A:
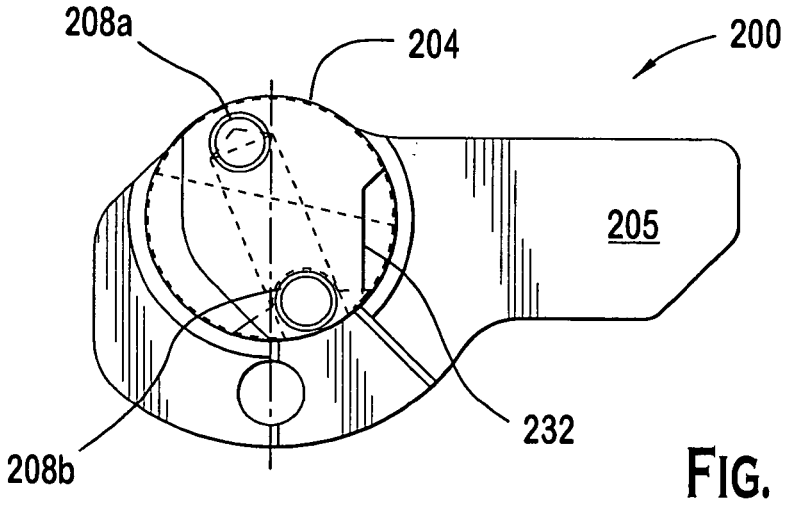
FIG. 12A is a side view of the left thumb-lever of the pistol of FIG. 1 as seen from the drum side of the thumb-lever.
Figure 12B:
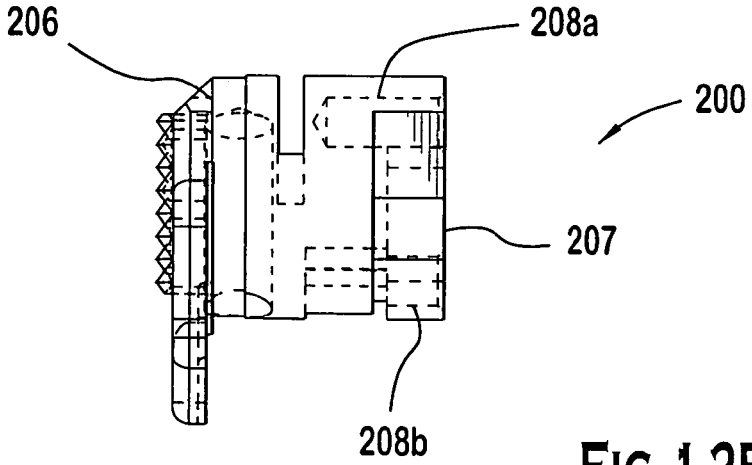
FIG. 12B is a rear view of the left thumb-lever of the pistol of FIG. 1.
Figure 12C:
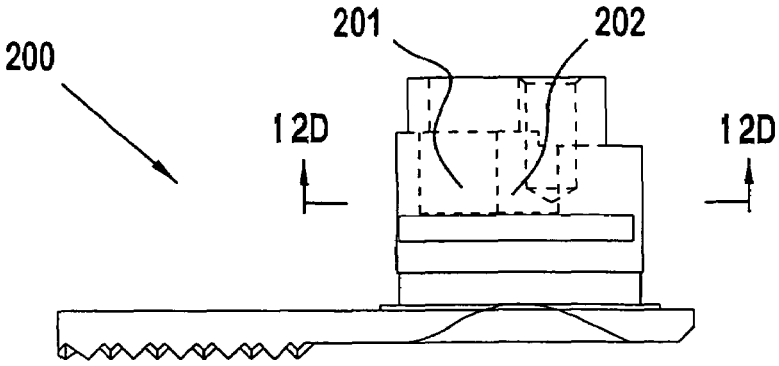
FIG. 12C is a top view of the left thumb-lever of the pistol of FIG. 1.
Figure 12D:
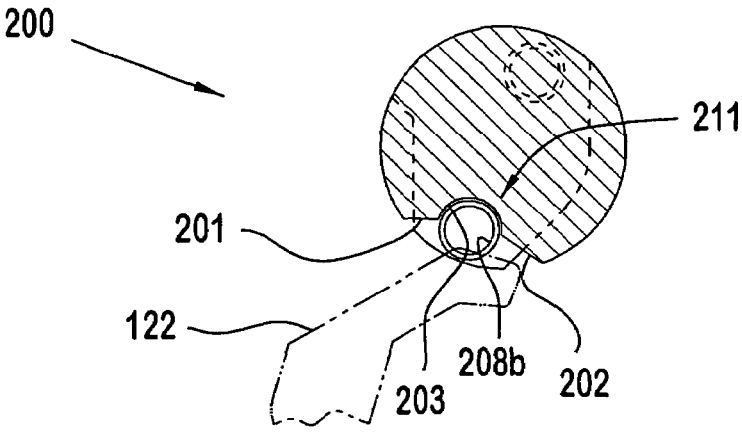
FIG. 12D is a left side cross-sectional view of the left thumb-lever of the pistol of FIG. 1 taken along line 12D-12D in FIG. 12C through the drum of the thumb-lever.
Figure 12E:
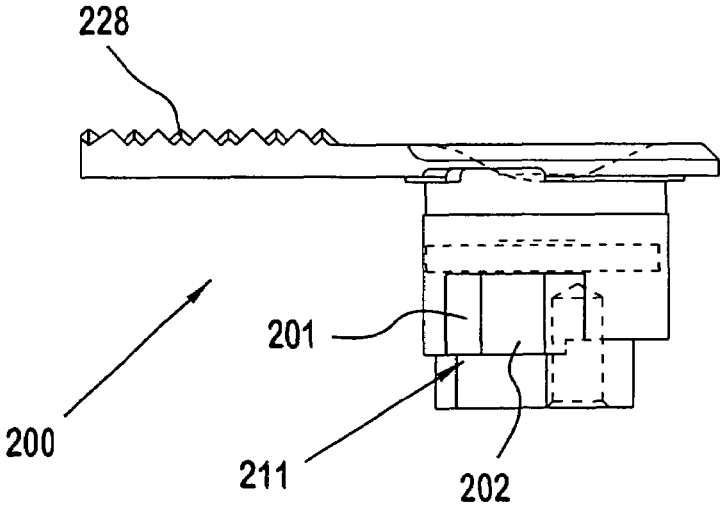
FIG. 12E is a bottom view of the left thumb-lever of the pistol of FIG. 1.
Figure 12F:
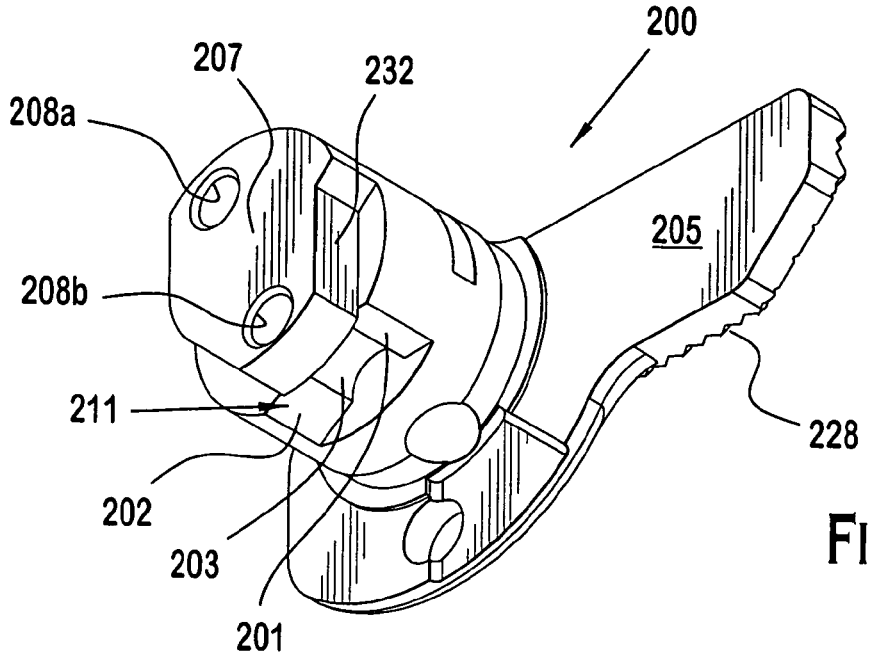
FIG. 12F is a perspective view of the left thumb-lever of the pistol of FIG. 1.

Referring to FIGS. 12-12F, left thumb-lever 200 includes a generally cylindrical drum 204 having a circular-shaped outer end 206 (facing outwards from pistol 20 when mounted in slide 22) and circular-shaped inner end 207 (facing inwards towards pistol 20). A substantially planar flange 205 is disposed on outer end 206 and extends generally perpendicular to drum 204 as shown. At least a portion of flange 205 may have a roughened surface or undulating surface feature, such as diamond-checkering 228 as shown, striations (grooves or ridges), knurling, etc., to assist with preventing slippage by contact with the user's thumb. When mounted in slide 22, flange 205 preferably extends longitudinally towards the front of pistol 20 when in an upward and preferably inactivated position, as shown in FIGS. 1 and 2. Flange 205 may be an integral part of drum 204 or a separate component attached to the drum by commonly known techniques in the art.

Various holes, recesses, and other features are preferably formed into drum 204 to accommodate operationally-related components. Drum 204 defines two recesses 208*a*, 208*b* to receive tenon pins 210*a*, 210*b*, respectively, to mechanically couple left thumb-lever 200 to right thumb-lever 220. Tenon pins 210*a*, 210*b* (best shown in FIG. 22C) are preferably cylindrical in shape and received in corresponding recesses 221*a*, 221*b* in right thumb-lever 220 (see FIG. 13). Preferably, the tenon pin recesses in the left and right thumb-levers are arranged and the thumb-levers installed such that the position of each thumb-lever's respective thumb flanges are the same during the range of movement by the pistol user.

With specific reference to FIGS. 12C-12F, left thumb-lever 200 is operably associated with sear 120 (and indirectly with firing pin 130 by virtue of tenon pins 210*a*, 210*b* which operably couple the movement of right thumb-lever 220 to left thumb-lever 200, as explained below). In one embodiment as shown, left thumb-lever 200 is preferably configured and arranged to operably engage sear disengagement lever 122 (see FIG. 15). Accordingly, left thumb-lever 200 in the preferred embodiment may have generally rectilinear recess 211 formed in the bottom portion of left thumb-lever drum 204, as shown. Recess 211 includes two generally flat and adjacent surfaces 201, 202. These two surfaces 201, 202 preferably are disposed at an angle to each other which compliments corresponding angled surfaces 122*a*, 123*a* of sear lever 122 to provide positive engagement and seating of sear lever 122 with left thumb-lever drum 204. A curved and concave cutout 203 may be provided between recess 211 surfaces 201 and 202 to accommodate the angled edge formed between angled surfaces 122*a* and 123*a* of sear lever 122 (compare FIGS. 12D and 15). For clarity, the profile of sear lever 122 is shown in dashed lines in FIG. 15D to illustrate how sear lever 122 may be positioned with respect to thumb-lever recess 211. When left thumb-lever 200 is rotated downward and counter-clockwise (as viewed in FIG. 2) by a user of pistol 20, thumb-lever surface 201 and drum 204 contacts sear lever surface 122*a*. This rotates sear 122 in a clockwise direction (with orientation reference to FIG. 2) which disengages sear hook 125 from hammer notch 186, thereby releasing hammer 34. This motion is used to decock hammer 34 from the "ready-to-fire" position shown in FIG. 2, as further explained below.

Figure 13:
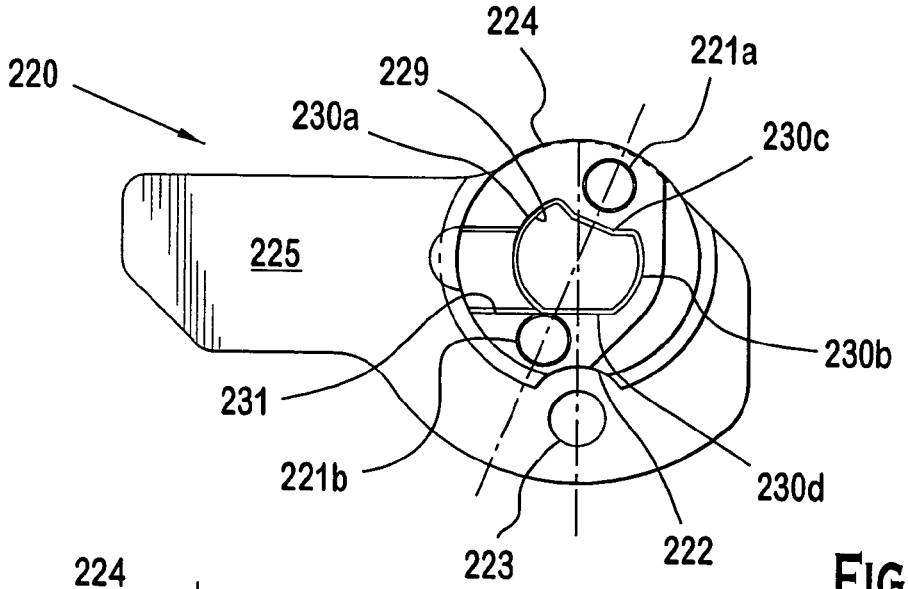
FIG. 13 is a left side view of the right thumb-lever of the pistol of FIG. 1 as seen from the drum side of the thumb-lever.
Figure 13A:
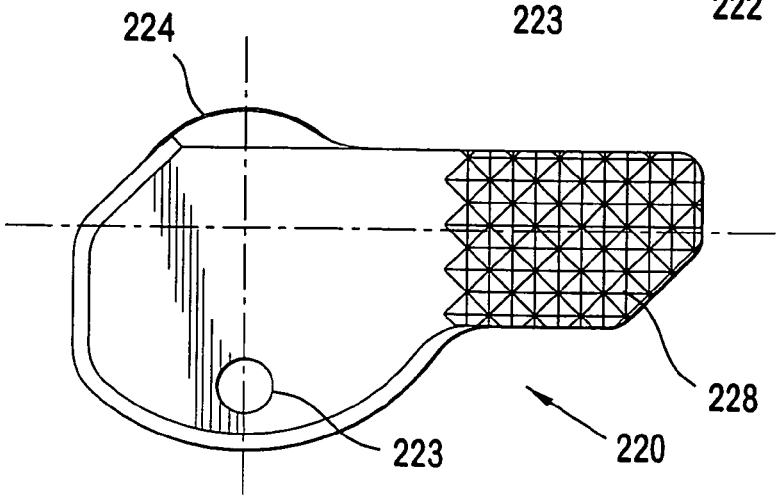
FIG. 13A is a right side view of the right thumb-lever of the pistol of FIG. 1 as seen when mounted in the housing of the pistol.
Figure 13B:
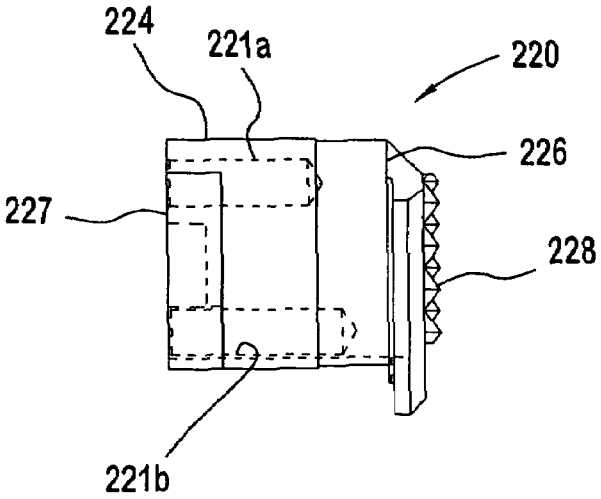
FIG. 13B is a rear view of the right thumb-lever of the pistol of FIG. 1.
Figure 13C:
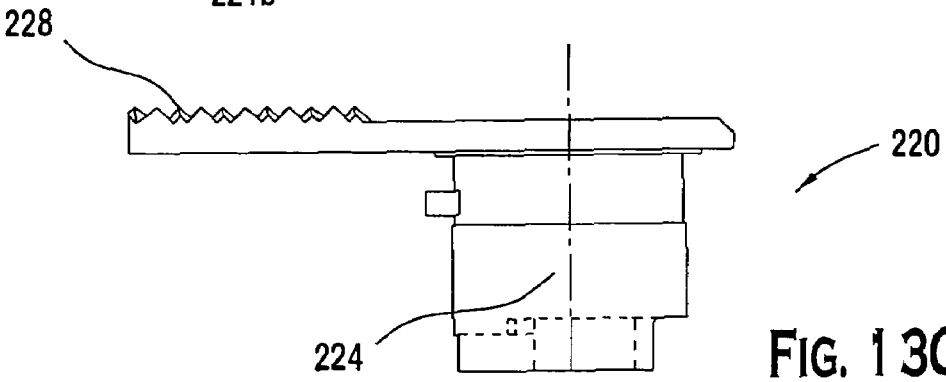
FIG. 13C is a top view of the right thumb-lever of the pistol of FIG. 1.
Figure 13D:
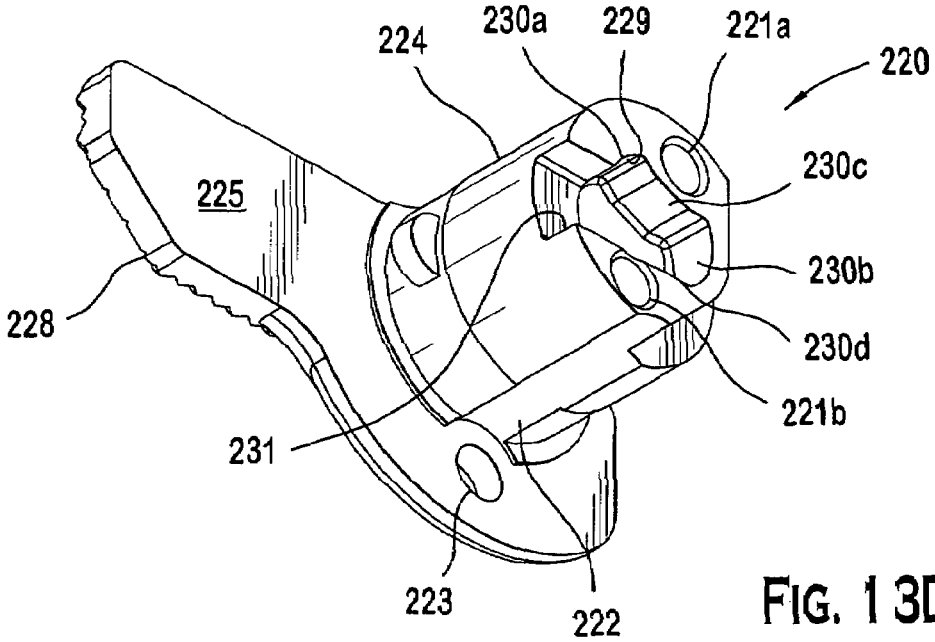
FIG. 13D is a perspective view of the right thumb-lever of the pistol of FIG. 1.

Right thumb-lever 220 is shown in FIGS. 13-13D, and is preferably similar to left thumb-lever 200 in overall size and shape. Right thumb-lever 220 is operably associated directly with firing pin 130, and indirectly with sear 120 by virtue of tenon pins 210*a*, 210*b* which operably couple the movement of right thumb-lever 220 to left thumb-lever 200. Right thumb-lever 220 includes a generally cylindrical drum 224 having a circular-shaped outer end 226 (facing outwards from pistol 20 when mounted in slide 22) and circular-shaped inner end 227 (facing inwards towards pistol 20). Drum 224 defines two recesses 221*a*, 221*b* to receive tenon pins 210*a*, 21*b*, as described above. A curved, laterally-extending concavity 222 may be provided in drum 224 (see FIG. 13) which is operably associated with the internal key lock mechanism, specifically lock pin 280 (see FIG. 18) described further below. Preferably, concavity 222 is formed in the bottom surface of drum 224.

Figure 22:
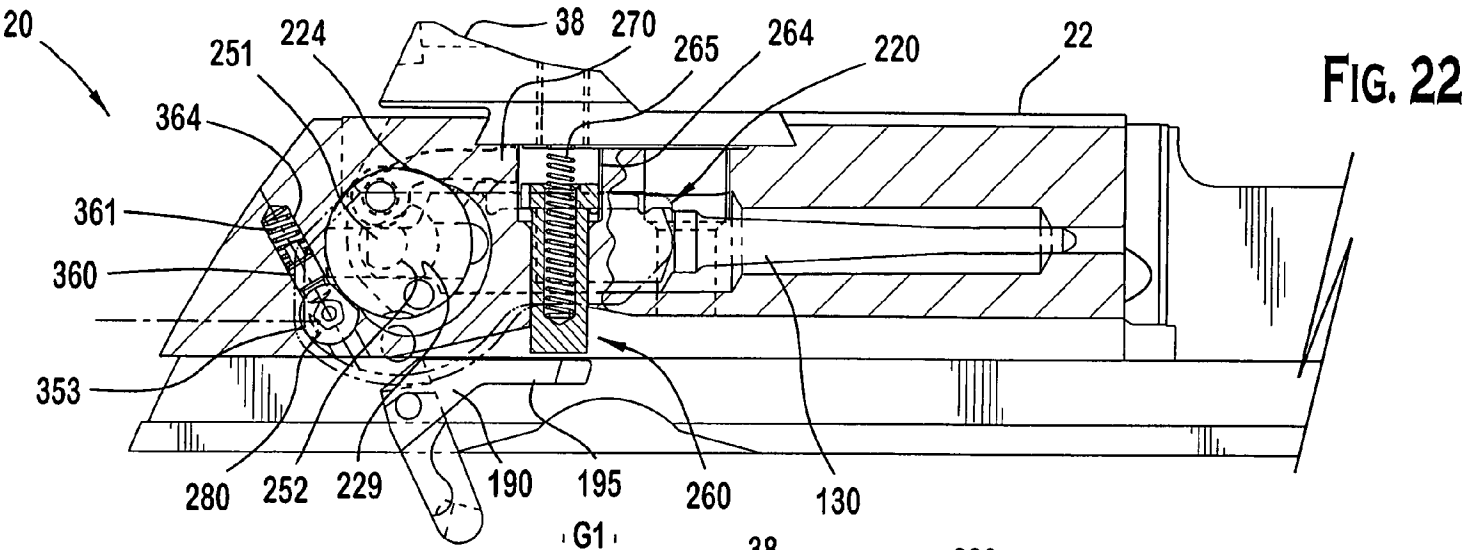
FIG. 22 is a partial right side section view of the pistol of FIG. 1 showing components of the firing pin locking mechanism and the right thumb-lever in an upward "ready-to-fire" position.

A substantially planar flange 225 is disposed on outer end 226 and extends generally perpendicular to drum 224 as shown. At least a portion of flange 225 may have a roughened surface or undulating surface feature similar to left thumb-lever 220, such as diamond-checkering 228 as shown. When mounted in slide 22, flange 225 preferably extends longitudinally towards the front of pistol 20 when in an upward and preferably inactivated position, as shown in FIG. 22. Flange 225 may be an integral part of drum 224 or a separate component attached to the drum by commonly known techniques in the art.

Flange 225 may further include a keyhole 223 as shown in FIG. 13 which preferably extends completely through the flange. Keyhole 223 is operably associated with the internal key lock mechanism, specifically lock pin 280 (see FIG. 18). Accordingly, keyhole 223 is configured to removably receive the shaft 302 of a lock key 300 (see FIG. 19) which operably engages lock pin 280. In the preferred embodiment, keyhole 223 is located in flange 225 to become movable into axial and concentric alignment with a companion aperture 179 formed in the rear of slide 22 proximate to right thumb-lever external hole 178*b* (see FIG. 4B). Aperture 179 provides access through slide 22 to the internal key lock mechanism. The operation of the key lock mechanism, and right thumb-lever keyhole 223 and slide aperture 179 will be further described below.

It should be noted that both left thumb-lever 200 and right thumb-lever 220 are assembled to pistol 20 with their respective drums 204, 224 inserted through external holes 178*a*, 178*b* (see FIGS. 4A, 4B) in slide 22, and interconnecting the thumb-levers with tenon pins 210*a*, 210*b*. Thumb flanges 205, 225 remain external to pistol 20 and are accessible to the pistol user.

With continuing reference to FIGS. 13-13D, drum 224 of right thumb-lever 220 defines a recess 229 configured to receive and operably engage lateral boss 251 of firing pin 130. Preferably, recess 229 opens externally on at least one side, and more preferably extends outwards through inner end 227 of drum 224. Recess 229 includes front wall 230*a*, rear wall 230*b*, top wall 230*c*, and bottom wall 230*d* that circumscribe recess 229. In the preferred embodiment, front wall 230*a* and rear wall 230*b* have a generally arcuate shape as shown. Recess 229 is preferably configured and sized sufficiently larger than lateral boss 251 to allow for longitudinal displacement of lateral boss 251 within recess 229 concomitantly with movement of firing pin 130, as noted below A forwardly-open slot 231 may be provided that communicates with recess 229. When right thumb-lever 220 is in an upright and "ready-to-fire" position, slot 231 allows firing pin lateral boss 251 to advance forward and leave recess 229 by a sufficient amount necessary to permit firing pin 130 to strike cartridge 50 and discharge pistol 20 (see FIG. 22A).

Drum 204 of left thumb-lever 200 includes a cam 232 on a forward-facing portion of the drum (see FIGS. 12 and 12F) which engages cam follower surface 233 on firing pin 130 (see FIGS. 14 and 14A). When left thumb-lever 200 is moved downward to its "safe" position, cam 232 engages cam follower surface 233 and moves firing pin 130 forward with its laterally-extending boss 251 remaining inside recess 229 of the right thumb-lever. Accordingly, rotation of left thumb-lever 200 and concomitantly drum 204 moves firing pin 130 from a first rearward longitudinal position to a second forward longitudinal position within firing pin cavity 106 (shown in FIG. 2). In the "safe" position, slot 231 on right thumb-lever 220 is pointed downwards and blocks the forward path of boss 251 so firing pin 130 cannot advance forward beyond recess 229 to strike a chambered cartridge 50 (see FIG. 23A).

Figure 16:
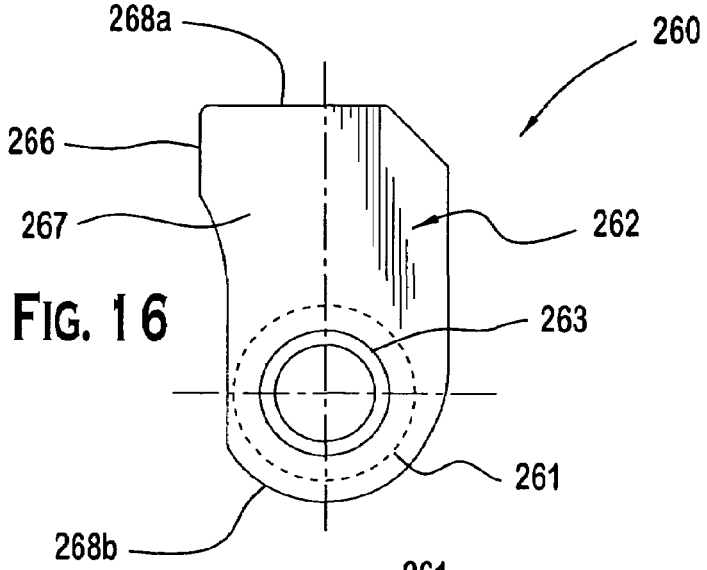
FIG. 16 is a top view of the firing pin block of the pistol of FIG. 1.
Figure 16A:
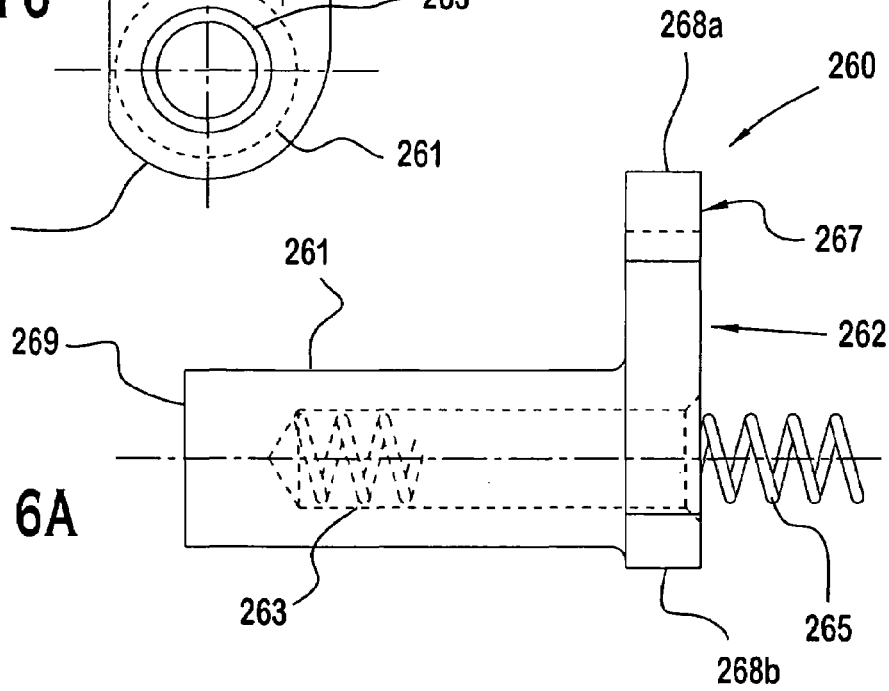
FIG. 16A is a rear view of the firing pin block of the pistol of FIG. 1.
Figure 16B:
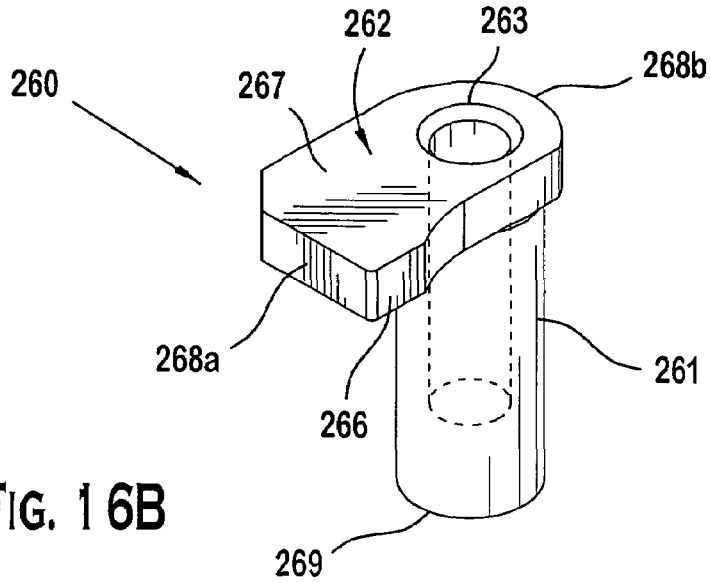
FIG. 16B is a perspective view of the firing pin block of the pistol of FIG. 1.

Another component of the pistol firing pin locking mechanism is a blocking member such as firing pin block 260 shown in FIGS. 16-16B. Firing pin block 260 may include a cylindrical mounting shaft 261 and blocking flange 262 arranged generally perpendicular to mounting portion 261, as shown. Flange 262 preferably is an integral unit with mounting shaft 261; however, flange 262 may be a separate component attached to the stem by any suitable method known in the art. Numerous suitable and techniques for attaching flange 262 to shaft 261 are possible so long as a rigid connection between both elements is created. Flange 262 further has a free end 268*a* distal to mounting shaft 261 and an opposite end 268*b* proximate to shaft 261. Flange 262 includes a substantially flat rearward-facing vertical surface 266 to contact and blockingly engage upwardly-extending protrusion 244 of firing pin 130 when the firing pin attempts to move in a forward direction. Preferably, surface 266 is disposed on flange 262 near end 268*a*. Firing pin block 260 may further include a top surface 267 to operably contact bottom surface 279*a* on strut 270 thereby creating a blocking relationship between the two elements. Preferably, top surface 267 is disposed near end 268 and adjacent to forward-facing surface 266.

Shaft 261 may be slidably received in vertically-oriented hole 264 of slide 22 as shown in FIG. 5B, and preferably is capable of upward and downward reciprocating vertical motion inside hole 264 such that firing pin block 260 may move like a piston. In one embodiment as shown, hole 264 is preferably positioned in slide 22 offset from the centerline (coinciding with longitudinal axis LA as shown) of firing pin cavity 106, but proximate to firing pin cavity 106 such that flange 262 is positioned close enough to engage firing pin 130. When shaft 261 is located in hole 264 of slide 22, flange 262 is preferably oriented to extend in a lateral direction towards firing pin cavity 106. Also preferably, hole 264 has an open bottom such that at least part of shaft 261 may be projected beyond the hole to be operably engaged by firing pin blocker-lever 190. Flange 262, which makes abutting contact with the surface of firing pin 130 beyond the perimeter of hole 264 regulates the extent to which shaft 261 projects beyond and below hole 264. A cylindrical recess 263, which preferably opens through flange 262, may be provided in shaft 261 to receive a biasing member such as helical spring 265 (see FIG. 16A). When firing pin block 260 is mounted in pistol 20, spring 265 biases firing pin block 260 in a downward direction into blocking engagement with firing pin 130 (see FIG. 2).

As shown in FIGS. 5A and 5B, rear sight landing 108 in slide 22 contains a cutout 356 which is configured and sized to allow firing pin block flange 262 to be inserted therethrough. Cutout 356 preferably communicates with the rear portion of firing pin cavity 106 to allow flange 262 to operably engage firing pin 130, as described herein.

Figure 17A:
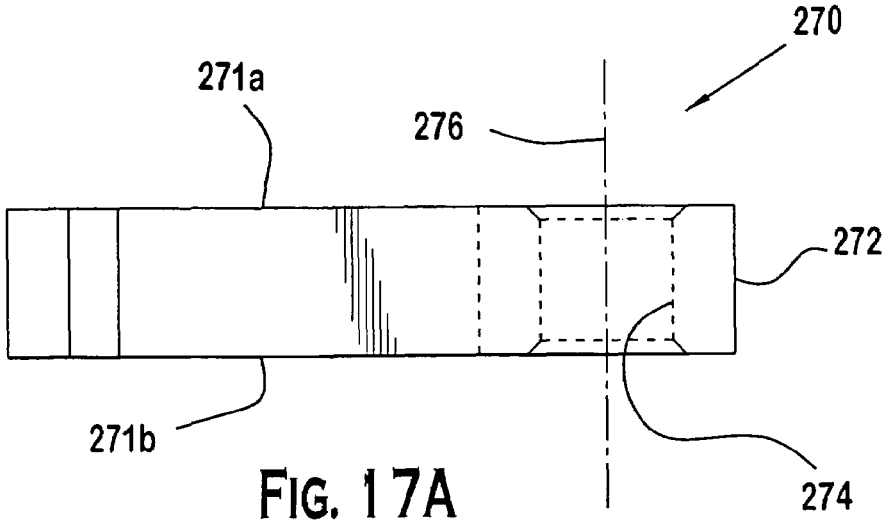
FIG. 17A is a top view of the strut of the pistol of FIG. 1.
Figure 17:
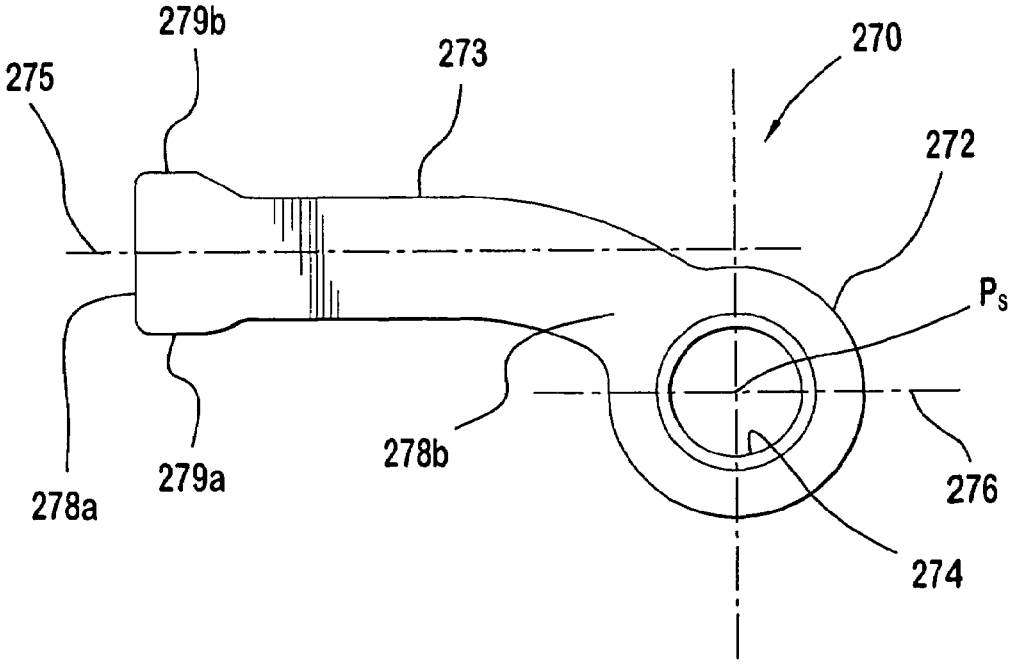
FIG. 17 is a left side view of the strut of the pistol of FIG. 1.

The preferred embodiment further includes a moveable stopping member or stop such as strut 270 shown in FIG. 17-17A. In one position, strut 270 acts to obstruct and prevent vertical motion of firing pin block 260 so that firing pin block 260 cannot disengage from firing pin 130. Preferably, strut 270 may be generally bar-shaped with flat sides 271*a*, 271*b* and includes a mounting portion 272 and a preferably elongate stopping portion 273 extending from mounting portion 272. In one embodiment as shown, mounting portion 272 may be circular in shape. Stopping portion 273 and mounting portion 272 may be part of an integral unit formed from single piece of material. Alternatively, stopping portion 273 and mounting portion 272 may be separate components joined together by any suitable technique commonly used in the art. Mounting portion 272 may have round hole 274 to pivotally mount strut 270 about tenon pin 210*a*, as shown for example in FIG. 22E. Accordingly, the movement of strut 270 may preferably be joined to the movement of thumb-lever mechanism 215. In the preferred embodiment, rotating thumb-lever mechanism 215 selectively moves strut 270 in a longitudinal forward and rearward direction between an obstructing position wherein strut 270 obstruct upward movement of firing pin block 260 and a non-obstructing position wherein strut 270 does not obstruct movement of firing pin block 260.

Stopping portion 273 has a distal free end 278*a* and a proximate end 278*b* attached to or integral with mounting portion 272. Free end 278*a* is unconstrained and rotationally movable about tenon pin 210*a* of thumb-lever mechanism 215 which defines a pivot point "Ps" for strut 270. Elongate stopping portion 273 defines a longitudinal axial centerline 275 which preferably is offset from longitudinal axial centerline 276 of mounting hole 274 and pivot point Ps, as shown in FIG. 17. Stopping portion 273 may be curved as shown near proximate end 278*b* to provide a smooth transition to the offset. The distal end 278*a* may be enlarged in contrast to the rest of stopping portion 273 as shown to facilitate contact with firing pin block 260 and provide a positive blocking relationship between strut 270 and firing pin block 260. An inclined ramp may be provided to make the transition between enlarged end 278*a* and smaller proximate end 278*b*. Alternatively, ends 278*a* and 278*b* may be the same size without any enlargement, or proximate end 278*b* may be enlarged in contrast to distal end 278*a*.

Figure 22A:
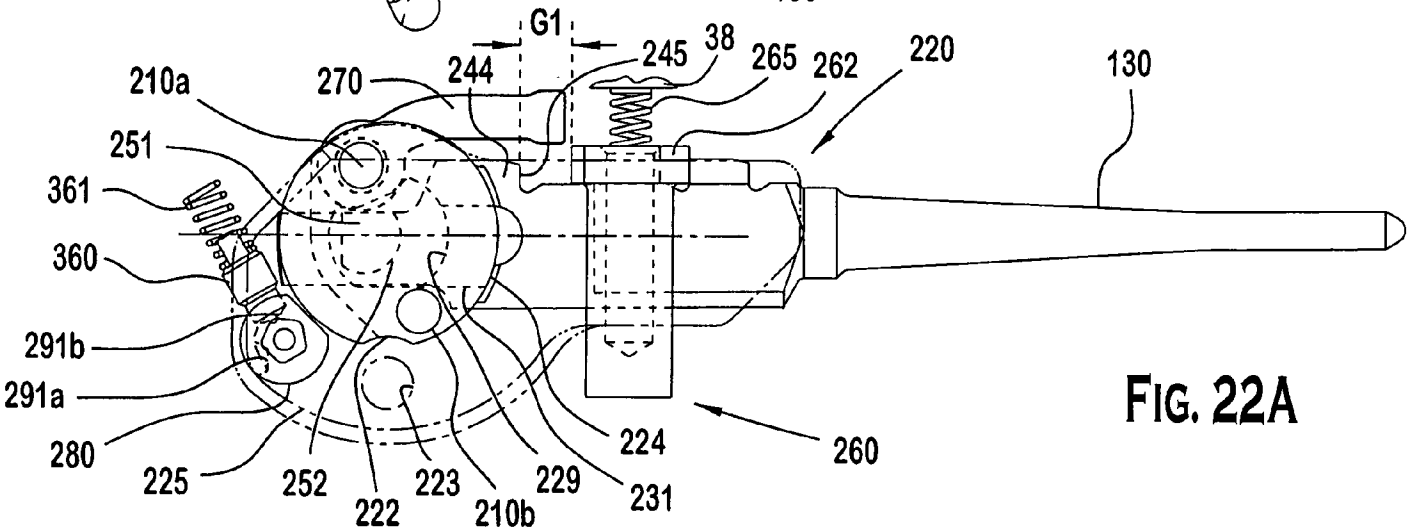
FIG. 22A is a right side view of the firing pin and firing pin locking mechanism of pistol of FIG. 1 shown disembodied from the pistol and the strut shown disengaged from the firing pin block.

As shown by comparing FIG. 22A with 23A, thumb-lever mechanism 215 acts as a rotary or rotatable actuator that imparts axial longitudinal movement to strut 270 by virtue of the pivotal mounted of strut 270 about tenon pin 210*a* of thumb-lever mechanism 215. According, turning thumb-lever mechanism 215 moves strut 270 in a roughly linear manner into and out of a stopping or obstructing relationship with pin block 260 to prevent pin block 260 from being disengaged from firing pin 130.

In the preferred embodiment, strut 270 acts as a stop or wedge between firing pin block 260 and slide 22 to prevent vertical movement of the firing pin block strut 270 may include a bottom surface 279*a* and top surface 279*b*, which preferably form part of stopping portion 273. Bottom surface 279*a* may be configured and arranged on strut 270 to operably engage and contact top surface 267 of firing pin block 260 (see FIG. 16), thereby creating a blocking relationship between these two components. Top surface 279*b* may be configured and arranged on strut 270 to operably contact the slide 22 or a component attached thereto, which in the preferred embodiment is bottom surface 144 of rear sight 38 (see FIG. 20), thereby creating a blocking relationship between these two components. Accordingly, in one possible position of strut 270 as further described below, stopping portion 273 may become interspersed between bottom surface 144 of rear sight 38 and top surface 267 of firing pin block 260 to obstruct upward movement of firing pin block 260. In the preferred embodiment, strut 270 is movable via the foregoing mechanical pivotal linkage to the thumb-lever mechanism 215 from a first rearward position in which strut 270 does not obstruct the upward movement of firing pin block 260 (i.e., a non-obstructing position) to a second forward position in which the upward movement of firing pin block 260 is obstructed (i.e., an obstructing position). The interaction of strut 270 with firing pin block 260 is further elaborated below in discussing the operation of the pistol firing pin locking mechanism.

Although strut 270 is preferably located and mounted in pistol 20 such that movement from the first non-obstructing position to the second obstructing position occurs in a longitudinal direction, it will be appreciated that strut 270 may be arranged to move in a transverse and lateral direction or any other suitable direction so long as strut 270 may be moved to a position which operably obstructs firing pin block 260 from moving vertically.

With reference now to FIGS. 20 and 20A, rear sight 38 is preferably mounted to horizontal landing surface 108 in top surface 110 of slide 22 (see FIG. 2). Rear sight 38 has a top surface 142, bottom surface 144, rear end 145, and a front sloping surface 146. The intersection of surfaces 144 and 146 define a leading edge 148. When rear sight 38 is mounted in pistol 20 as shown in FIG. 2, bottom surface 144 acts as an upper limit stop that contacts top surface 279*b* of strut 270 to create a blocking relationship between firing pin block 260 and strut 270. Rear sight 38 further includes a top sighting surface 143 which in one embodiment is preferably recessed below spaced-apart peak surfaces 147 at the rear of sight 38. Preferably, rear sight 38 is mounted to landing surface 108 of slide 22 via a press-fit dovetail connection between slide 22 and rear site 38. A threaded fastener (not shown) is insertable through threaded fastener hole 141 in rear sight 38 which abuts landing surface 108 as added security.

Figure 18:
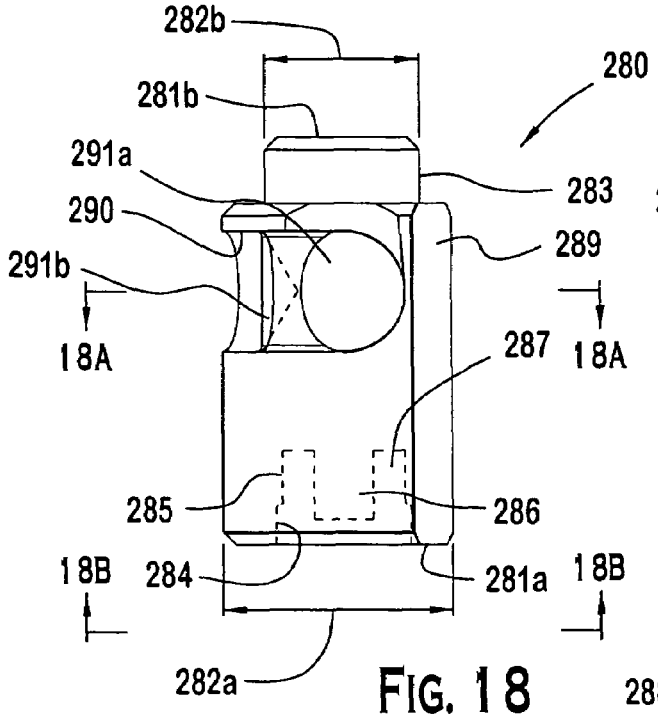
FIG. 18 is a top view of the lock pin of the pistol of FIG. 1.
Figure 18A:
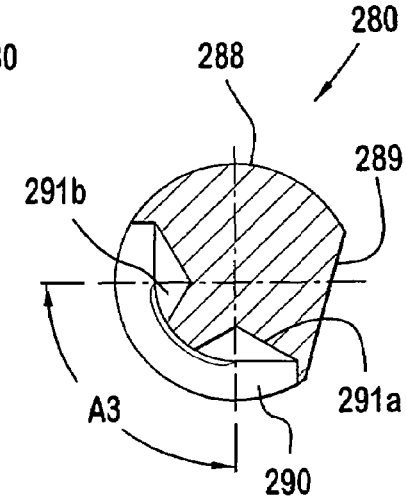
FIG. 18A is a cross-sectional view of the lock pin of the pistol of FIG. 1 taken along line 18A-18A in FIG. 18 through the detent plunger indentations.
Figure 18B:
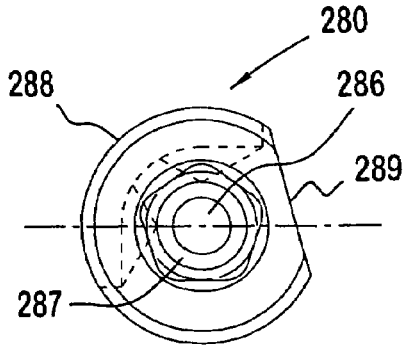
FIG. 18B is a side view of the lock pin of the pistol of FIG. 1 showing the lock key recess.
Figure 18C:
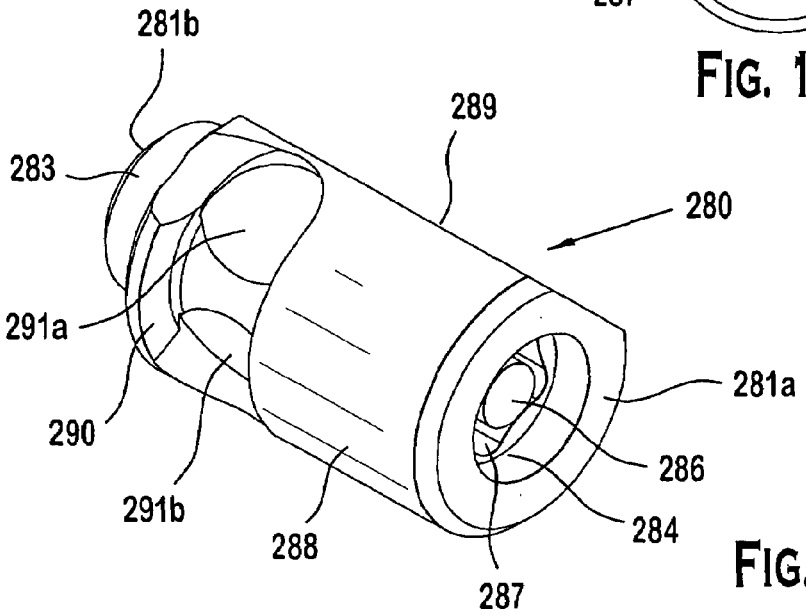
FIG. 18C is a perspective view of the lock pin of the pistol of FIG. 1.

In one embodiment, thumb-lever mechanism 215 preferably may further include a rotationally movable locking member such as lock pin 280 as shown in FIGS. 18-18C. Lock pin 280 preferably is a key-lock mechanism and allows the position of thumb-lever mechanism 215 to be locked into the "safe" position, as shown for example in FIG. 23A. Although in the preferred embodiment lock pin 280 may be operably associated with right thumb-lever 220, lock pin 280 may alternatively be operably associated with left thumb-lever 200. Also preferably, lock pin 280 is located inside pistol 20 in slide 22.

Figure 22B:
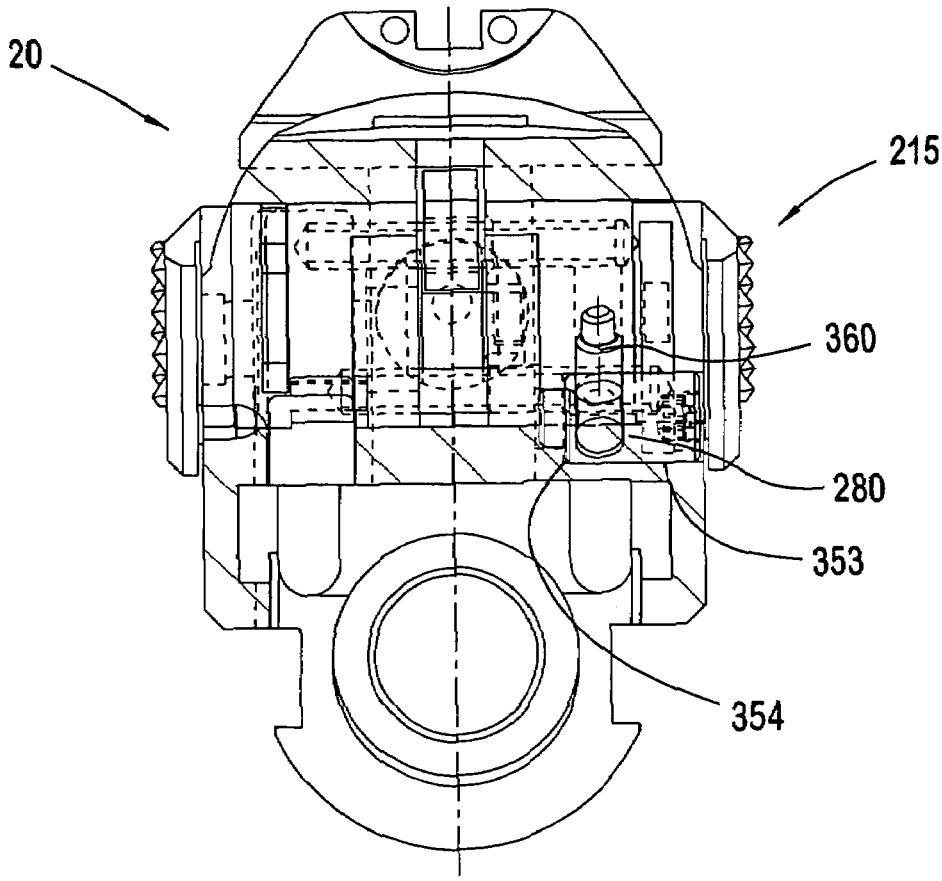
FIG. 22B is a partial rear section view taken through the thumb-lever holes in the housing of the pistol of FIG. 1 showing components of the firing pin locking mechanism.
Figure 22C:
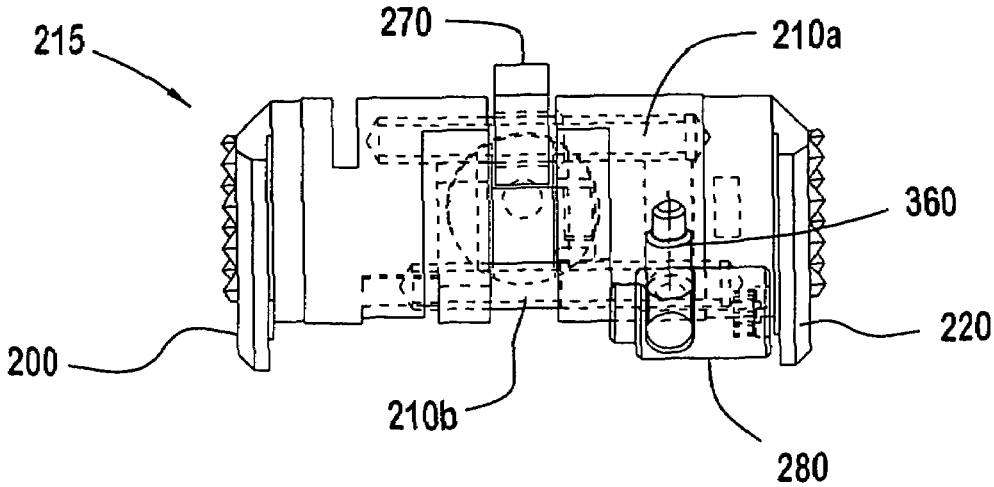
FIG. 22C is a rear view of the firing pin locking mechanism of the pistol of FIG. 1 shown disembodied from the pistol.

Lock pin 280 may be generally cylindrical in shape as shown and rotatably disposed in a lock pin cavity 353 in slide 22 (see FIG. 22). Lock pin cavity 353 is preferably located proximate to right thumb-lever external hole 178*b* so that right thumb-lever drum 224 may be operably engaged. Lock pin 280 includes a key-engagement end 281*a* and an opposite end 281*b*. Projecting axially from end 281*b* may be a stem 283 which in the preferred embodiment has a smaller diameter 282*b* than the diameter 282*a* of end 281*b*. Stem 283, with its reduced diameter, helps to positively locate the position of lock pin 280 in cavity 353. To accommodate smaller diameter stem 283, lock pin cavity 280 may be provided with a shoulder 354 producing a complimentary portion of cavity 280 having a smaller inside diameter than the rest of cavity 280 (best shown in FIG. 22B). It will be appreciated that lock pin 280 and concomitantly lock pin cavity 353 may have a generally constant diameter without a reduction in size such that stem 283 has the same diameter 281*b* as the diameter 281*a* of the rest of lock pin 280. Alternatively, lock pin 280 may be provided without any stem 283 in another embodiment.

Key-engagement end 281*a* preferably includes a key-receiving recess 284 defined by internal walls 285 which opens externally through end 281*a*. In cross section, recess 284 preferably has a shape configured to compliment the shape of a lock key 300 (see FIG. 19) intended to be used with pistol 20 and inserted into recess 284 to operably engage lock pin 280. In one embodiment, as shown in end view FIG. 18B, recess 284 may be pentagon-shaped in cross section to compliment key 300 which may have a pentagon-shaped shaft 302 in cross section (see FIG. 19A). It will be appreciated that numerous other suitable cross-sectional shape combinations of lock pin recesses and keys are possible without limitation so long as the lock pin may be operably engaged by the key. In the preferred embodiment, key-receiving recess 284 may further include an internal cylindrically-shaped protrusion 286 that defines an annular space 287. Protrusion 286 is preferably concentrically aligned with recess 284, as shown. Internal protrusion 286 mates with and is received by complimentary-shaped cylindrical recess 304 provided in the lock-engaging end 303 of lock key 300 (see FIG. 19).

Figures 23, 23A:
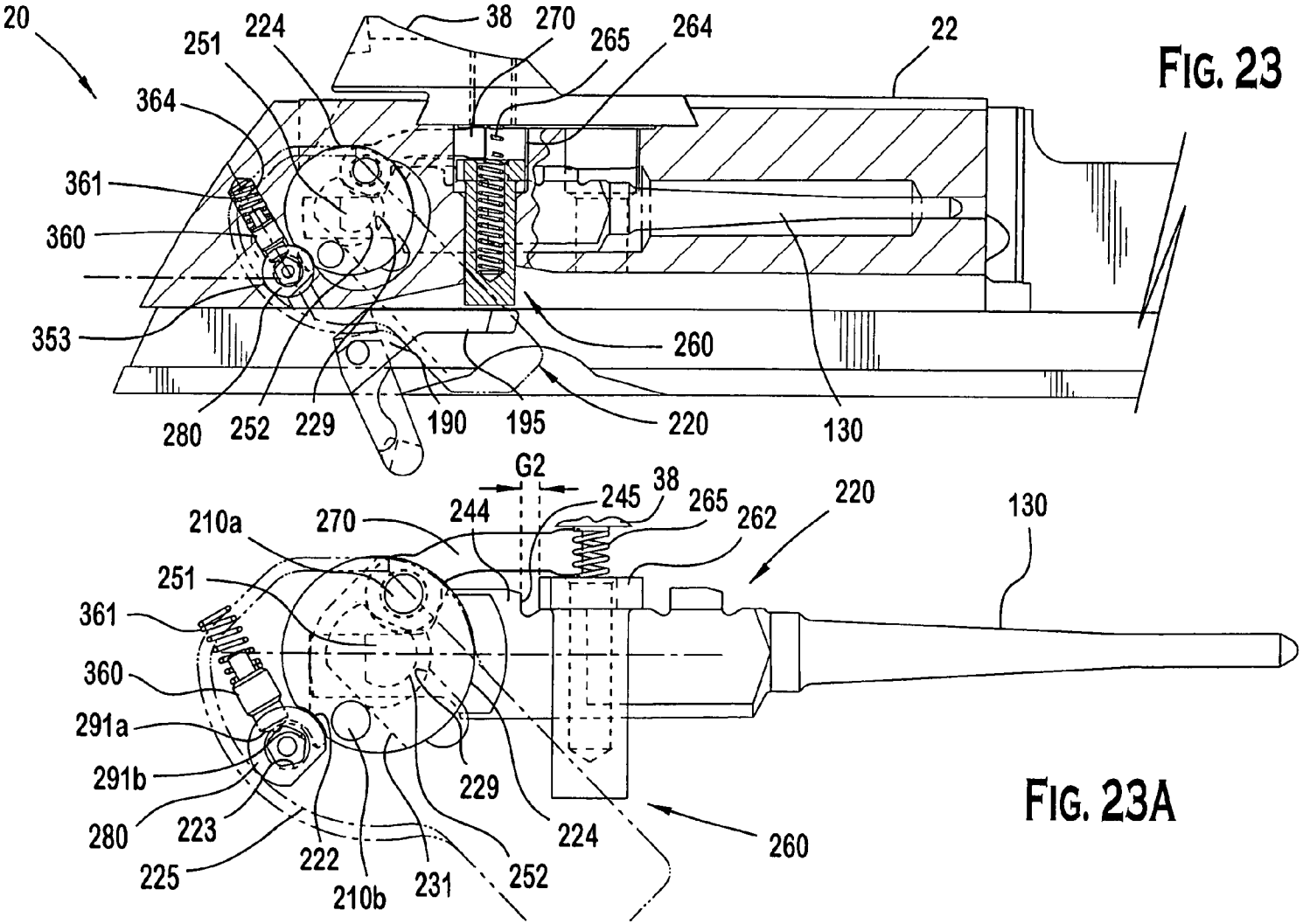
FIG. 23 is a partial right side section view of the pistol of FIG. 1 showing components of the firing pin locking mechanism and the right thumb-lever in a downward "safe" position.
FIG. 23A is a right side view of the firing pin and firing pin locking mechanism of pistol of FIG. 1 shown disembodied from the pistol and the strut shown engaged with the firing pin block.
Figure 23B:
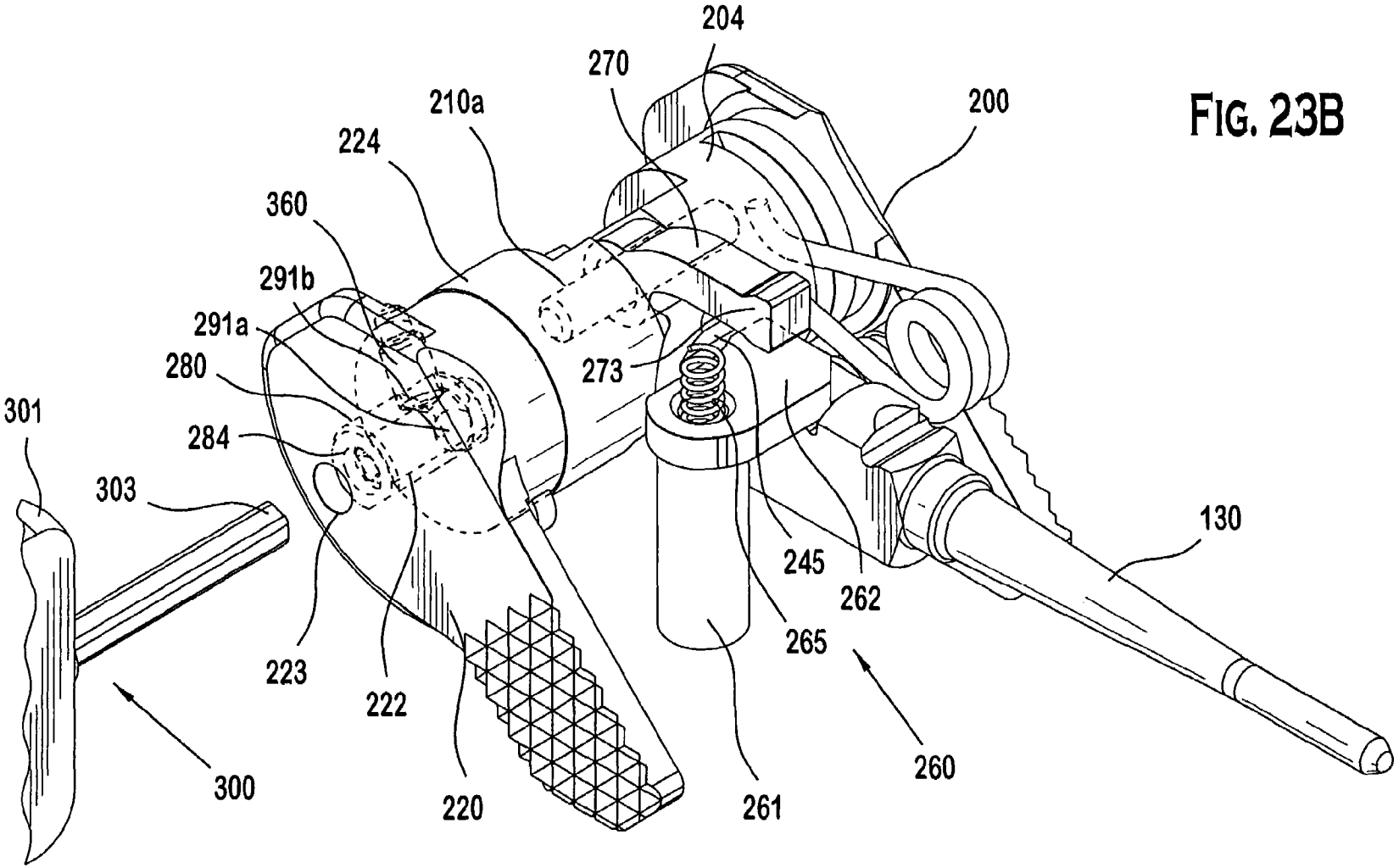
FIG. 23B is a perspective view showing components of the firing pin locking mechanism.

In the preferred embodiment, lock pin 280 further includes an external cylindrical sidewall 288 having a generally round cross-sectional shape. At least a portion of sidewall 288 may include a substantially flat surface 289 (best shown in FIG. 18B). External sidewall 288 and flat surface 289 in different rotational positions of lock pin 280 may be moved into and out of stopping engagement with drum 224 of right thumb-lever 220. Thus in one embodiment, by using key 300, lock pin 280 may be rotated from a first "unlocked" position in which right thumb-lever 220 may be freely rotated to a second "locked" position in which the rotational movement of thumb-lever 220 is blocked by interference with lock pin 280. With reference to FIG. 22A, the first unlocked position is shown wherein flat surface 289 of lock pin 280 faces drum 224 of right thumb-lever 220 which in the preferred embodiment is cylindrical in shape. Flat surface 289 does not contact or may slightly contact drum 224 so long as right thumb-lever 220 may be freely rotated. With reference to FIG. 23A, the second locked position is shown wherein laterally-extending concavity 222 of right thumb-lever drum 224 is stoppingly engaged with cylindrical external sidewall 288 of lock pin 280. The operation of lock pin 280 as it relates to the thumb-lever mechanism 215 will be described in more detail below.

To positively define the foregoing locked and unlocked positions of lock pin 280, a spring-loaded detent may be provided which includes a detent plunger 360 and detent plunger spring 361 (see, e.g. FIGS. 16 and 21). Spring 361 may be a helical spring, as shown. Detent plunger 360 is preferably cylindrical in shape and includes an insertion end 362 and a stem 365 projecting axially from an opposite end 363, as shown in FIG. 21. Stem 365 may be smaller in diameter than end 363. Stem 365 helps to locate and center spring 361 within a detent cavity 364 formed in slide 22 (see FIG. 22) to slidably receive detent plunger 360. Preferably, detent cavity 364 is cylindrical and physically communicates with lock pin cavity 353 to allow detent plunger 360 to engage lock pin 280, as shown in FIG. 22.

Detent plunger 360 may be received in a slot 290 formed into cylindrical sidewall 288 of lock pin 280. Preferably, slot 290 extends at least partially around the circumference of lock pin 280, as shown. Within slot 290, in one embodiment, are two indentations 291*a*, 291*b* configured and sized to receive insertion end 362 of detent plunger 360. Indentations 291*a*, 291*b* are preferably disposed at a 90 degree angle A3 to each other. This allows a quarter turn of lock pin 280 to move between the locked and unlocked positions. Detent plunger spring 361 biases detent plunger 360 towards engagement with indentations 291*a*, 291*b*.

Figure 19:
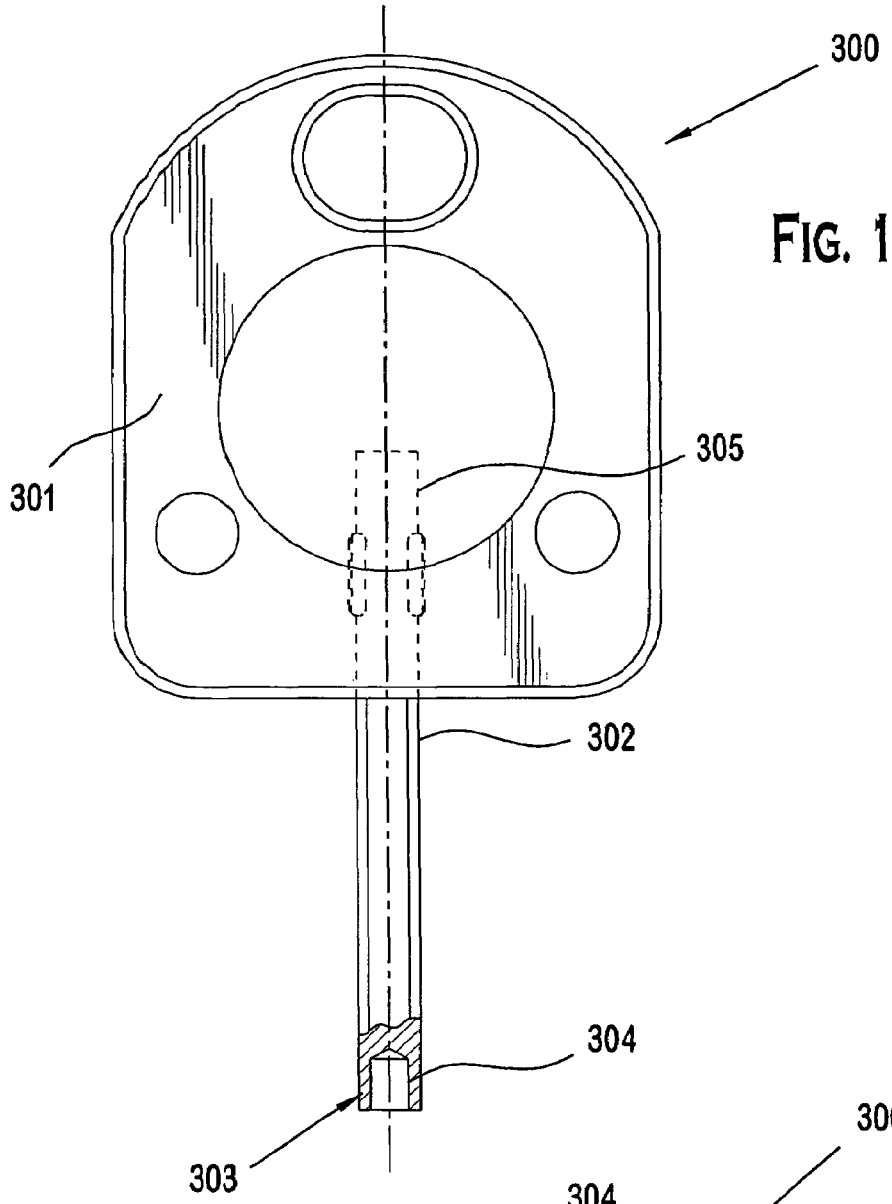
FIG. 19 is a top view of the lock key of the pistol of FIG. 1 useable with the lock pin.
Figure 19A:
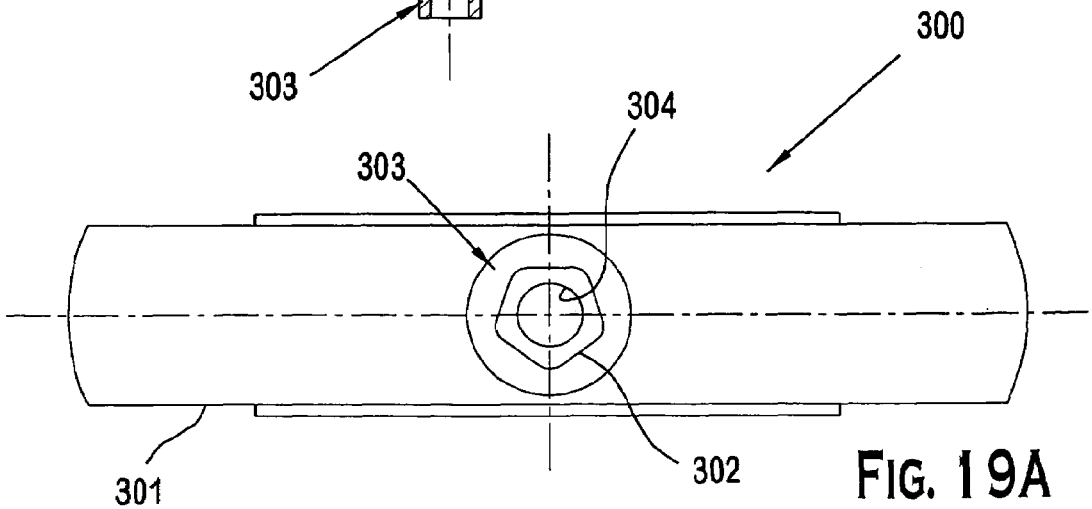
FIG. 19A is an enlarged bottom view of the lock key of the pistol of FIG. 1.

Referring specifically to FIG. 19, lock key 300, which may be used to operably engage lock pin 280 as noted above, includes a generally flattened handle 301 mounted to an elongated key shaft 302 at one end 305. At an opposite end of shaft 302 is lock engaging end 303 which preferably is configured to mate with correspondingly configured recess 284 of lock pin 280 (see FIG. 19, and discussion above). Key 300 allows access to internal lock pin 280 so that lock pin 280 may be rotationally moved in position between the foregoing locked and unlocked positions described above.

The foregoing components are preferably made of a suitable metal such as steel and/or titanium. Preferably, the components (with possible exception of the springs) may be made of stainless steel.

Operation of pistol 20 as it relates to the preferred embodiment of the ambidextrous thumb-lever mechanism 215 and related components will now be described with primary reference to FIGS. 22 and 23, including all subpart drawings.

FIG. 22 depicts ambidextrous thumb-lever mechanism 215 in the "ready-to-fire" position, which correlates with FIG. 2 (the corresponding position of components of the firing assembly 60 are also shown). Both left and right thumb-levers 200, 220 are in an upward position with their respective thumb flanges oriented in the direction of the longitudinal axis LA pointed towards the front of pistol 20. As shown in FIG. 2, cartridge 50 is fully loaded in chamber 48 and positioned to be struck by firing pin 130 to discharge pistol 20. Hammer 34 is fully cocked (i.e., rearward) and trigger 32 is in a partial rearward position with pistol 20 in the single-action firing mode, described above. Rear hammer end 241 of firing pin 130 protrudes through thumb-lever mechanism 215 and into hammer slot 175 so that it is positioned to be struck by hammer 34 when released by pulling trigger 32.

Figure 22D:
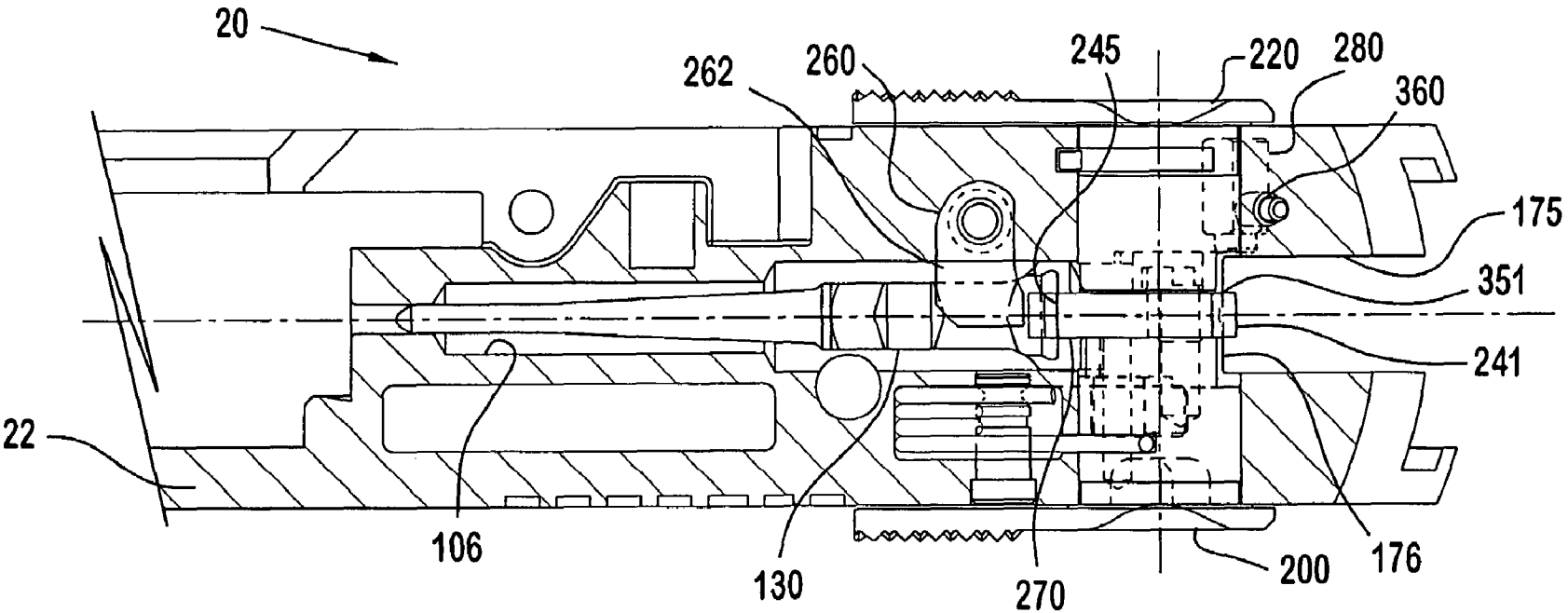
FIG. 22D is a partial top section view taken through the thumb-lever holes in the housing of the pistol of FIG. 1 showing components of the firing pin locking mechanism.
Figure 22E:
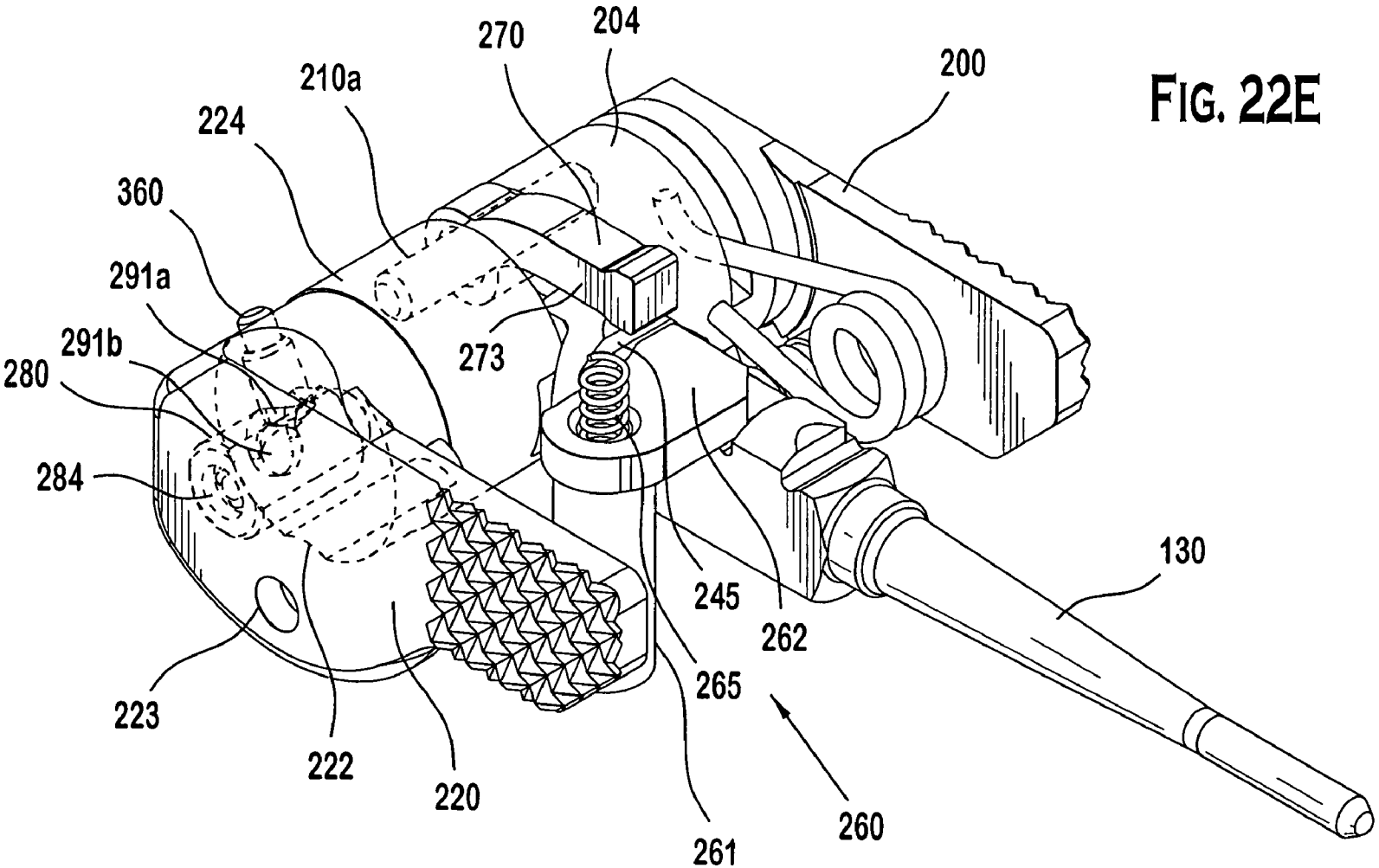
FIG. 22E is a perspective view showing components of the firing pin locking mechanism.

As best shown in the disembodied view of thumb-lever mechanism 215 and firing pin 130 shown in FIG. 22A, firing pin block 260 is in a first downward blocking position such that firing pin block flange 262 (specifically rearward-facing contact surface 266) blocks the forward path of upwardly-extending protrusion 244 on firing pin 130 to prevent the firing pin from reaching and striking cartridge 50. As depicted in FIGS. 22A and 22D, there is no requirement that firing pin block surface 266 be in direct contact with upwardly-extending protrusion 244 of firing pin 130 to establish an effective blocking relationship between firing pin block 260 and firing pin 130. Accordingly, a gap "G1" between contact surface 266 of firing pin block 260 and upwardly-extending protrusion 244 is permissible, as is some limited forward travel of firing pin 130, provided that firing pin 130 cannot reach cartridge 50 before contact surface 266 stoppingly engages protrusion 244 of firing pin 130.

Still referring to the "ready-to-fire" position and FIGS. 22A and 22D, strut 270 is shown in a rearward non-obstructing position such that stopping portion 273 of strut 270 does not extend over the top of firing pin block 260. Accordingly, firing pin block 260 may be freely moved vertically upwards to a second non-blocking position (not shown) wherein flange 262 of firing pin block 260 is raised to a sufficient height such that flange 262 no longer blocks the forward path and movement of firing pin 130 (i.e., flange 262 would no longer engage firing pin upward protrusion 244 as firing pin 130 moves forward when struck from the rear by hammer 34). Firing pin block 260 is moved upwards in discharging pistol 20 by the trigger 32 pull which rotates firing pin blocker-lever 190 (see FIG. 11) in a clockwise motion (with reference to FIG. 2), as described above. This concomitantly causes lever arm 195 of blocker-lever 190 to rotate upwards, thereby contacting the bottom 269 of firing pin block 260 to displace firing pin block 260 (and specifically flange 262) to the upward non-blocking position. The upward displacement of firing pin block 260 occurs just before firing pin 130 is struck from the rear by hammer 34 and moved forward to contact cartridge 50 to discharge pistol 20.

With continuing reference to FIG. 22, laterally-extending boss 251 on firing pin 130 is shown located in and near the rear of recess 229 (shown in dashed lines) in right thumb-lever drum 224 such that space is available in front of curved surface 252 for forward movement of boss 251 within recess 229. In the shown position of boss 251, rear hammer end 241 of firing pin 130 protrudes outwards from the rear of slide 22 so that firing pin 130 may be struck by hammer 34 to discharge pistol 20 (see FIG. 22D).

Referring now to FIG. 23, ambidextrous thumb-lever mechanism 215 is shown in the "safe" or "locked" position wherein pulling trigger 32 will not discharge pistol 20. Both left and right thumb-levers 200, 220 are in a downward position with their respective thumb flanges angled in a downward direction at an angle to the longitudinal axis LA of pistol 20. When thumb-lever mechanism 215 is rotated to this "safe" position from the "ready-to-fire" position as shown in FIG. 22, top tenon pin 210*a* rotates forward and clockwise (when viewed from FIGS. 22 and 23). Concomitantly, strut 270 pivotally connected to tenon pin 210*a* is moved forward to an obstructing position as best shown in FIG. 23A wherein firing pin block 260 is prevented from moving vertically upwards. Accordingly, pulling trigger 32 cannot move firing pin block 260 (via blocker-lever 190) to the non-blocking position in the manner described above as when thumb-lever mechanism is in the "ready-to-fire" position. Therefore, the forward path of firing pin 130 remains blocked by firing pin block 260 despite the trigger pull, and firing pin 130 cannot move fully forward as needed to strike a chambered cartridge 50 and discharge pistol 20. Thus, pistol 20 cannot be discharged by a trigger pull when strut 270 is in its forward obstructing position.

It should further be noted that trigger 32 is effectively locked in position and cannot be moved rearward when thumb-lever mechanism 215 is in the "safe" position.

Accordingly, hammer 34 (linked to trigger 32 by trigger bar 70) also cannot be moved in response to an attempted trigger pull.

According to another aspect of the preferred embodiment, moving thumb-lever mechanism 215 downwards to the "safe" position may also cause firing pin 130 to move forward from a protruded position (shown in FIG. 22D and described above) to a retracted position (not shown) wherein rear hammer end 241 of firing pin 130 is retracted from hammer slot 175 in slide 22 (see FIG. 5) and moves inside thumb-lever mechanism 215. This occurs by the interaction of cam 232 on left thumb-lever 200 (see FIGS. 12 and 12F) engaging cam follower surface 233 on firing pin 130 (see FIGS. 14 and 14A), as described above. When left thumb-lever 200 is moved downward to its "safe" position, cam 232 engages cam follower surface 233 and moves firing pin 130 forward. This limited displacement of firing pin 130 is preferably sufficient to withdraw the firing pin from hammer slot 175 in slide 22 (see FIG. 5) and retract rear firing pin end 241 inside thumb-lever mechanism 215 through opening 351 therein so that rear end 241 cannot be contacted by hammer 34 if actuated by trigger 32. Boss 251 is now located towards the front of recess 229 of right thumb-lever 220, as shown in FIG. 23. Accordingly, rotation of left thumb-lever 200 moves firing pin 130 from a first rearward longitudinal position in which firing pin 130 protrudes outward from slide 22 and thumb-lever mechanism 215 to a second forward longitudinal position in which firing pin 130 is retracted into slide 22 and thumb-lever mechanism 215.

The operation of lock pin 280 will now be described with primary reference to FIGS. 22 and 23, and FIG. 18 which depicts details of lock pin 280. In FIG. 22, with thumb-lever mechanism 215 in the upward "ready-to-fire" position, external flat sidewall surface 289 of lock pin 280 is shown positioned adjacent to right thumb-lever drum 224 such that right thumb-lever 220 may be freely rotated between the "ready-to-fire" and "safe" (locked) positions described above. Lock pin 280 is in a first "unlocked" position wherein lock pin 280 is not engageable with right thumb-lever drum 224. Concavity 222 is preferably disposed on the bottom of drum 224 when right thumb-lever 220 is mounted in pistol 20, as shown. Spring-loaded lock detent plunger 360 is preferably engaged with indentation 291*b* to assist with holding lock pin 280 in the unlocked position. In the preferred embodiment, keyhole 223 in right thumb-lever flange 225 is in approximately a 6 o'clock position in which the side of slide 22 occludes keyhole 223 such that key shaft 302 of lock key 300 cannot be inserted therethrough.

When thumb-lever mechanism 215 is pressed downward and rotated into the "safe" (locked) position shown in FIG. 23, two things occur. First, concavity 222 in right thumb-lever drum 224 has rotationally moved into a position adjacent to flat sidewall surface 289 of lock pin 280. Second, keyhole 223 in right thumb-lever flange 225 preferably is rotated to become concentrically aligned with companion aperture 179 formed in the rear of slide 22 proximate to right thumb-lever external hole 178*b* (see FIG. 4B). This allows key shaft 302 to be inserted through both keyhole 223 and aperture 179 to gain access to lock pin 280 located inside slide 22. Lock key 300 may now be inserted completely through slide 22 to engage lock engaging end 303 of key 300 (see FIG. 19) with cooperatively-shaped recess 284 of lock pin 280. The pistol user may then manually turn key 300 to rotate lock pin 280 clockwise into a "locked" position as shown in FIG. 23. In rotating lock pin 280 clockwise, external flat sidewall surface 289 of lock pin 280 no longer is positioned adjacent to right thumb-lever drum 224. Instead, a portion of lock pin external sidewall 288 which has a round cross-section has been rotated into position adjacent to right thumb-lever drum 224. This engages round external sidewall 288 with concavity 222 of right thumb-lever drum 224 to lock thumb-lever mechanism 215 in the "safe" (locked) position shown in FIG. 23. Key 300 may now be removed from slide 22. By rotating lock pin 280, detent plunger 260 has also moved from indentation 291*b* to 291*a* to assist with holding lock pin 280 in the locked position.

If the pistol user wants to return thumb-lever mechanism 215 (and pistol 20) to the "ready-to-fire" position, key 300 is reinserted into pistol 20 to reverse the above process and move lock pin 280 to its "unlocked" position.

It should be noted that the preferred embodiment of a pistol firing pin locking mechanism, including without limitation strut 270 and lock pin 280, may be used with manual thumb-lever return pistols (sometimes referred to as a "safety" model by some manufacturers) or automatic thumb-lever return pistols (sometimes referred to as "decocking" pistol model by some manufacturers). In the manual model, the thumb-levers must be manually moved between the "ready-to-fire" and "safe" (locked) positions. In automatic models, the thumb-levers are spring-loaded to automatically return from the "safe" position to the "ready-to-fire" position when the thumb-levers are released by the user while held in the downward "safe" position. In this latter model, the spring-loaded thumb-levers must be held down while the lock key 300 is used to lock the thumb-levers in the "safe" position.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A pistol with firing pin locking mechanism comprising:

a housing defining a longitudinal axis and a chamber to hold a cartridge;

a firing pin disposed in the housing and longitudinally movable in a forward direction to contact the cartridge;

a firing pin blocking member movable into and out of engagement with the firing pin, the firing pin blocked from forward movement when engaged by the blocking member;

a stopping member selectively movable along the longitudinal axis from an inactivated first axial position to a second activated axial position in which the stopping member engages and prevents the blocking member from being disengaged from the firing pin; and a first manually movable selector switch rotatably mounted in the housing and connected to the stopping member, the selector switch movable in a rotational direction to control the position of the stopping member between the first and second axial positions.

2. The pistol of claim 1, wherein the switch further comprises a tenon pin on which the stopping member is pivotally mounted.

3. The pistol of claim 1, wherein the switch is a thumb-lever.

4. The pistol of claim 1, further comprising a second selector switch rotatably mounted in the housing and mechanically coupled to the first switch such that turning one of the switches concomitantly turns the other switch in the same rotational direction, the stopping member being movable in position by turning either the first switch or second switch.

5. The pistol of claim 1, wherein the blocking member is movable from a first position in which the blocking member engages the firing pin to a second position in which the blocking member does not engage the firing pin, the stopping member operable to engage and prevent blocking member movement from the first position to second position.

6. The pistol of claim 1, wherein the blocking member is vertically movable and further comprises a top surface, and the stopping member further comprises a bottom surface, the bottom surface of the stopping member movable to engage the top surface of the blocking member when the blocking member is in the first position to prevent vertical movement of the blocking member.

7. The pistol of claim 5, further comprising a biasing member to bias the blocking member into the fast position engaging the firing pin.

8. The pistol of claim 1, wherein the stopping member is selectively movable by a user of the pistol into and out of engagement with the blocking member.

9. The pistol of claim 1, wherein the blocking member further comprises a vertically-oriented shaft with a laterally-protruding flange, the flange movable into and out of engagement with a top surface of firing pin.

10. The pistol of claim 9, wherein the flange further comprises a vertical surface that is engageable with a protrusion extending vertically upwardly from the top surface of the firing pin to prevent forward movement of firing pin.

11. The pistol of claim 1, further comprising a rotatable locking member operably associated with the stopping member, the locking member rotationally movable from an unlocked position to a locked position in which the stopping member is locked into engagement with the blocking member.

12. The pistol of claim 1, wherein the stopping member is a strut movable in a longitudinal direction between the first inactivated and second activated axial positions.

13. A pistol with firing pin locking mechanism comprising:

a housing defining a longitudinal axis and a chamber to hold a cartridge;

a firing pin disposed in the housing and movable in a forward longitudinal direction to strike the cartridge;

a firing pin blocking member movable into and out of engagement with the firing pin, the firing pin blocked from forward movement when engaged by the blocking member to prevent the firing pin from striking the cartridge;

a stopping member that is selectively movable along the longitudinal axis from an inactivated first axial position to a second activated axial position in which the stopping member prevents the blocking member from being disengaged from the firing pin;

a rotationally movable selector switch connected to the stopping member and controlling movement of the stopping member between the first and second axial positions by rotating the switch; and a rotationally movable locking member that engages and locks the selector switch in at least one position in which the stopping member simultaneously is in the second activated position.

14. The pistol of claim 13, wherein the locking member is a lock pin rotatably mounted to the selector switch and configured to receive a cooperatively configured key used to turn the locking member.

15. The pistol of claim 14, wherein the lock pin includes a cylindrical external sidewall to engage a mating concavity formed in the selector switch which stoppingly receives the lock pin sidewall to lock the switch in position.

16. The pistol of claim 13, wherein the stopping member is a strut movable in a longitudinal direction between the first inactivated and second activated axial positions.

17. The pistol of claim 13, wherein the blocking member further comprises a vertically-oriented shaft with a laterally-protruding flange attached thereto that engages the firing pin, the strut obstructing vertical movement of the flange from disengagement with the firing pin.

18. A pistol with firing pin locking mechanism comprising:

a frame;

a housing attached to the frame, the housing defining a longitudinal axis and a chamber to hold a cartridge;

a firing pin disposed in the housing and longitudinally movable in a forward and rearward direction, at least a portion of the firing pin protruding outwards from the rear of the housing in one position;

a movable hammer pivotally mounted in the frame and positioned to physically contact the protruding firing pin to discharge the pistol;

a firing pin blocking member movable into and out of engagement with the firing pin, the firing pin blocked from forward movement when engaged by the blocking member:

stopping member selectively movable along the longitudinal axis from an inactivated first axial position to a second activated axial position in which the stopping member engages and prevents the blocking member from being disengaged from the firing pin;

a rotary selector switch operably engaged with the firing pin and the stopping member, the stopping member pivotally mounted to the switch, the switch rotatable between at least first and second rotational positions, the switch when moved from the first position to second position retracting the firing pin within the housing so that the hammer cannot contact the firing pin and discharge the pistol, the switch when moved from the first position to second position further simultaneously moving the stopping member into the second activated axial position to prevent the blocking member from being disengaged from the firing pin; and a rotationally movable locking member that in at least one position engages and holds the switch in the second position so that the hammer cannot contact the firing pin and the stopping member remains engaged with the blocking member.

19. The pistol of claim 18 wherein the locking member is a lock pin rotatably mounted to the selector switch and configured to receive a cooperatively configured key used to turn the locking member.

* * * * *